US008809771B2

(12) United States Patent
Syrstad

(10) Patent No.: US 8,809,771 B2
(45) Date of Patent: Aug. 19, 2014

(54) DEVICES, SYSTEMS, AND METHODS FOR DISPERSIVE ENERGY IMAGING

(75) Inventor: Erik Syrstad, River Heights, UT (US)

(73) Assignee: Utah State University Research Foundation, North Logan, UT (US)

( * ) Notice: Subject to any disclaimer, the term of this patent is extended or adjusted under 35 U.S.C. 154(b) by 459 days.

(21) Appl. No.: 13/107,609

(22) Filed: May 13, 2011

(65) Prior Publication Data

US 2011/0278448 A1 Nov. 17, 2011

Related U.S. Application Data

(60) Provisional application No. 61/345,422, filed on May 17, 2010.

(51) Int. Cl.
*H01J 49/00* (2006.01)
*H01J 40/14* (2006.01)

(52) U.S. Cl.
USPC ..... 250/282; 250/222.2

(58) Field of Classification Search
USPC ..... 250/282, 222.2
See application file for complete search history.

(56) References Cited

U.S. PATENT DOCUMENTS 3,665,241 A 5/1972 Spindt et al.
6,294,790 B1 * 9/2001 Weinberger ..... 250/397
6,369,384 B1 4/2002 Yefchak
7,038,203 B2 5/2006 Kuninaka et al.
8,093,565 B2 1/2012 Herrero et al.
2011/0180700 A1 * 7/2011 Finne et al. ..... 250/282

OTHER PUBLICATIONS

"The Gated Electrostatic Mass Spectrometer GEMS", pp. 1-16, NASA Goddard Space Flight Center, published Sep. 18, 2007 to Herrero et al.*
"The Gated Electrostatic Mass Spectrometer (GEMS): Definition and Preliminary Results", American Society for Mass Spectrometry, Published Jul. 18, 2008, pp. 1384-1394 to Herrero et al.*
Syrstad et al., A New Focus Lens for Improved Energy Resolution in the Wind and Temperature Spectrometer, poster presented at the American Geophysical Union Fall Conference, Dec. 14-18, 2010, San Francisco, California.
Syrstad et al., Performance Characterization of the Wind and Temperature Spectrometer (WATS), poster presented at the American Geophysical Union Fall Conference, Dec. 13-17, 2009, San Francisco, California.
Pilinski, Marcin et al., Wind and Temperature Spectrometer: Migrating from Nanosats to Cubesats, CEDAR Cubeseats—Science and Systems Workshop, Jun. 20, 2008, Zermatt, Utah.
Herrero et al, The WINCS Factory—First of Many Miniaturized Helio Instruments to be Delivered this Fall, available on http://www.nasa.gov/mission_pages/sunearth/news/wincs.html on Mar. 7, 2012.

* cited by examiner

*Primary Examiner* — David Porta
*Assistant Examiner* — Kenneth J Malkowski

(57) ABSTRACT

Devices, systems, and methods for dispersive energy imaging are disclosed. The full three-dimensional velocity distribution function of a flowing particle stream may be measured and properties of the particle stream characterized. In some devices, an aperture system controls the entry of a stream of particles into the sensor where an electrostatic deflector separates the stream of particles into different species, and a detector system senses the separated species.

25 Claims, 18 Drawing Sheets

DEVICES, SYSTEMS, AND METHODS FOR DISPERSIVE ENERGY IMAGING

CROSS-REFERENCE TO RELATED APPLICATIONS

This application claims the benefit of U.S. Provisional Patent Application No. 61/345,422, titled DEVICES, SYSTEMS, AND METHODS FOR DISPERSIVE ENERGY IMAGING, filed May 17, 2010, the entire contents of which are hereby incorporated by reference herein.

TECHNICAL FIELD

The present disclosure relates generally to devices, systems, and methods for dispersive energy imaging.

BRIEF DESCRIPTION OF THE DRAWINGS

The written disclosure describes illustrative embodiments that are non-limiting and non-exhaustive. Reference is made to certain of such illustrative embodiments that are depicted in the figures, in which.

DETAILED DESCRIPTION

Figure 1:
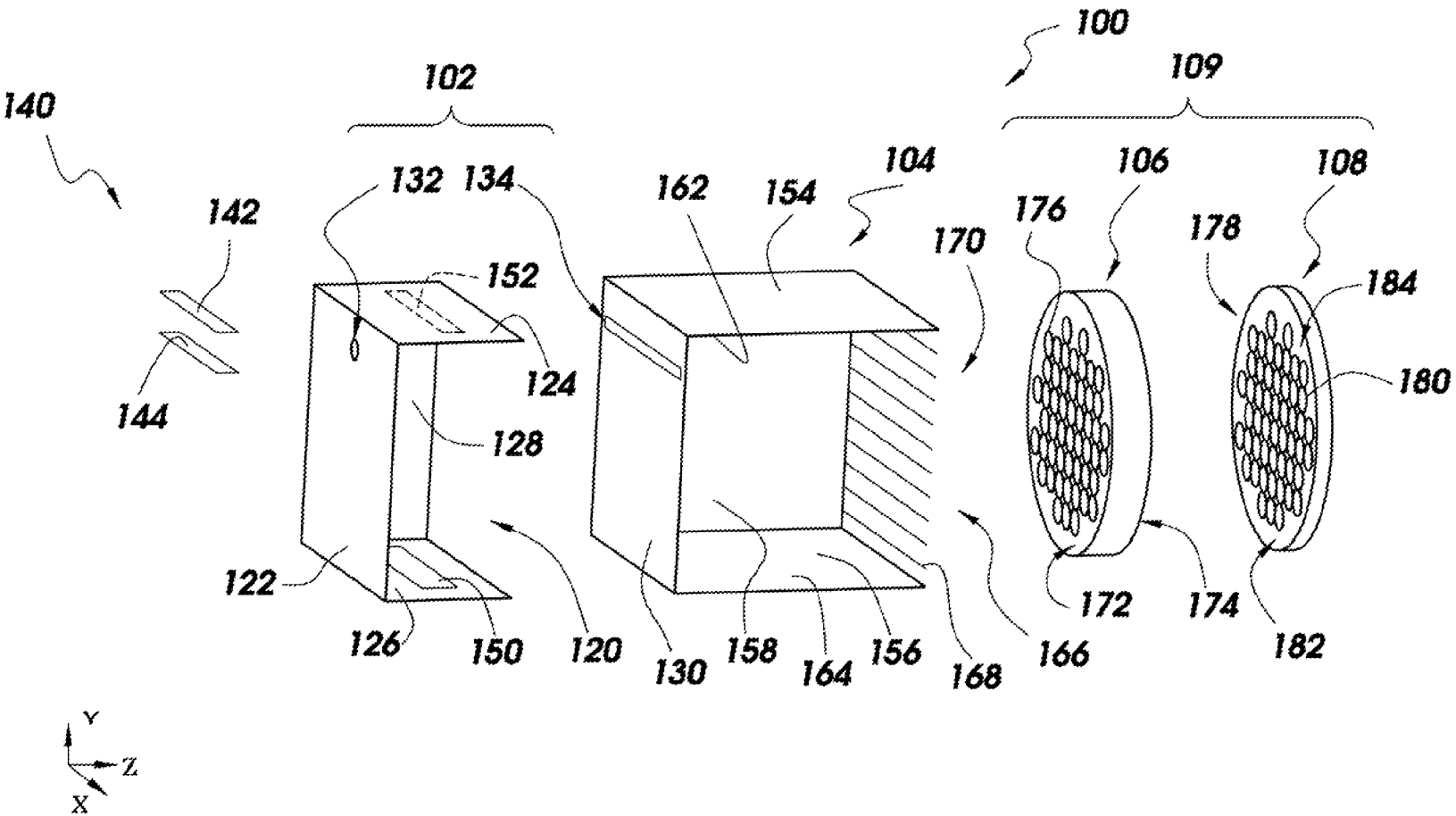
FIG. 1 is a schematic exploded, cutaway, perspective view of an embodiment of a sensor configured for use in dispersive energy imaging.

The Earth's ionosphere-thermosphere system is a region of major scientific interest. For example, ionosphere-thermosphere dynamics and coupling are active areas of research. Although the ionosphere-thermosphere system has been characterized by atmospheric models for periods of geomagnetic calm, its response to disruptive activities, such as storms, is poorly understood. During stormy periods, substantial energy is introduced into the upper atmosphere, which results in a highly structured environment that exhibits strong temporal and spatial variations.

Observation of the ionosphere-thermosphere system can be achieved by situating sensors therein so as to gather in situ measurements. For example, one or more sensors can be included onboard a spacecraft that travels through the ionosphere-thermosphere (e.g., an orbiting satellite). In some instances, it can be desirable to observe global atmospheric properties by compiling information regarding small-scale ionosphere-thermosphere structures at multiple positions. For example, simultaneous in situ measurements may be made via a network of sensors, and the measured properties can include composition, temperature, ion and/or neutral particle densities, ion drift velocities, and/or neutral wind velocities. Such multi-point measurements can be achieved via satellite constellations in which each satellite includes one or more appropriate sensors.

Disclosed herein are embodiments of devices, systems, and methods that can be used to measure the full three-dimensional velocity distribution function of a flowing particle stream, as in the characterization of atmospheric properties as mentioned above. Terrestrial applications include characterization of charged and neutral particle fluxes in the laboratory environment, such as supersonic atomic and molecular beams, ion and electron beams, and rarified flows in low-pressure wind tunnels. In general, the density, temperature, and velocity vector of any flowing particle stream may be determined. A well-known example and special case is a 'drifting Maxwellian', which has a bulk flow velocity exceeding the particle's random thermal velocities due to temperature. Relative motion between the sensor and analyte to effect such bulk flow may be provided by the sensor itself, or by the particles, or by a combination thereof, such as measurement of neutral winds or ion drifts from a moving spacecraft.

Certain embodiments can be well-suited for inclusion in small-scale satellites that may be used in constellation systems, such as satellites that conform to CubeSat specifications. For example, certain embodiments can have a compact configuration, low power consumption, and/or high sensitivity. Some embodiments can be used as a total thermosphere sensor, which can obtain complete in situ measurements of neutral winds (e.g., can measure the ram, cross-track horizontal, and cross-track vertical components, temperature, density, and composition of the thermosphere). Some sensors can simultaneously measure all relevant thermospheric parameters. Other embodiments can obtain similar data with respect to the ionosphere, and still further embodiments are capable of obtaining data of both the thermosphere and the ionosphere. Measurement of the other thermospheric parameters (density, composition, and temperature) is desirable as well, as this data may enable more accurate satellite tracking and spacecraft drag predictions through improved atmospheric models. The sensors can obtain such measurements with unprecedented sensitivity and accuracy, and certain may be configured to operating continuously over long-life mission durations (e.g., greater than 5 years). For example, some embodiments can be particularly well-suited for accurately measuring neutral winds with high spatial resolution in cold and rarified conditions. Other or further advantages of various embodiments described herein will be apparent from the disclosure that follows.

Figure 2:
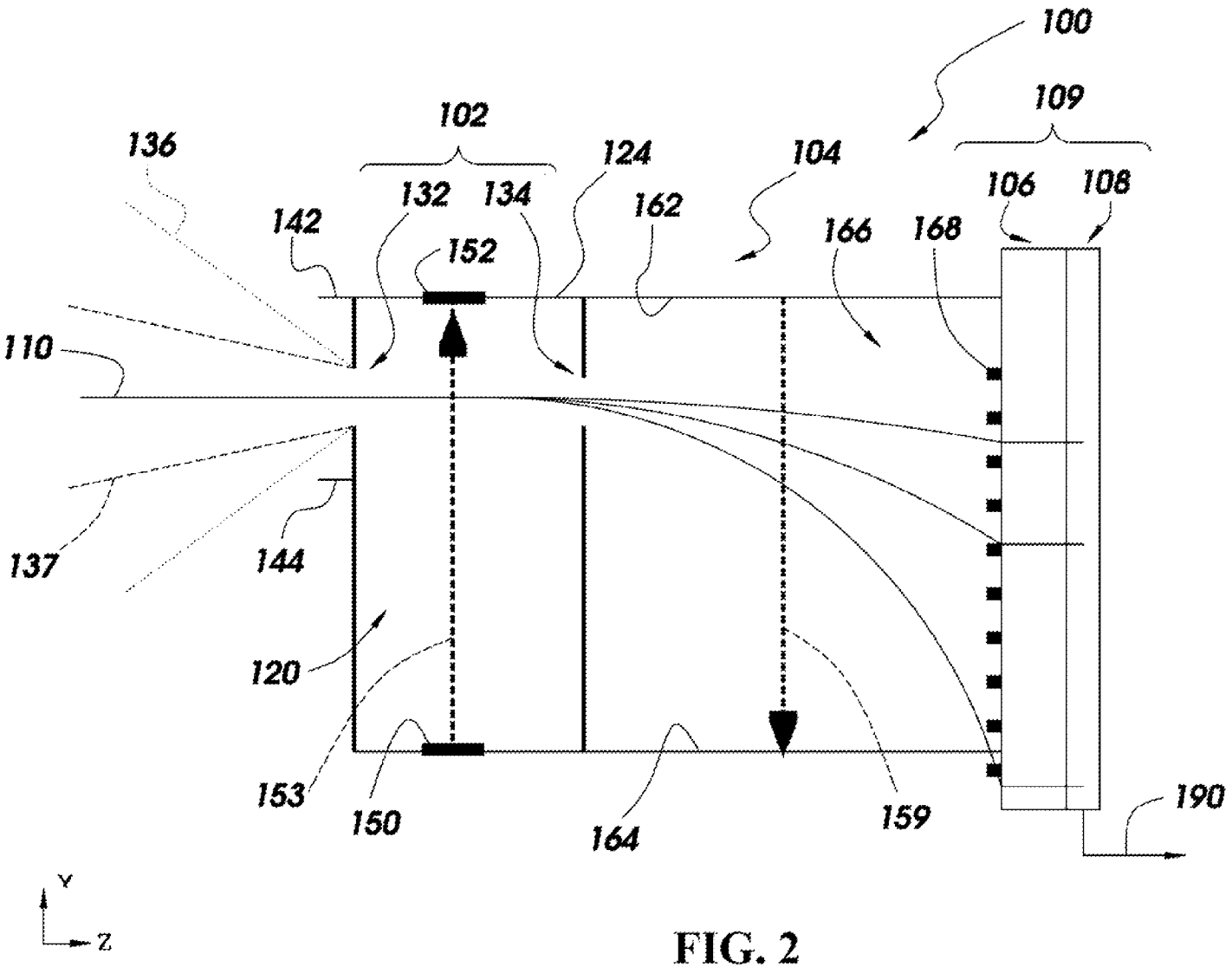
FIG. 2 is a schematic cross-sectional view of the assembled sensor of FIG. 1 illustrating a series of measurement events.

FIGS. 1 and 2 are schematic illustrations of an embodiment of a sensor 100, which can include an aperture system 102, an electrostatic deflector 104, and a detector system 109, comprising a microchannel plate 106 and an imaging readout 108. As shown in FIG. 2, and as discussed in greater detail below, the sensor 100 can receive an input stream 110 of particles through the aperture system 102 and can separate the particles in a vertical direction according to the kinetic energy of each particle via the electrostatic deflector 104. The deflected particles can be delivered to the microchannel plate 106, which produces amplified electron pulses at high gain corresponding to individual incident particles. The electron pulses have well-defined temporal and spatial characteristics, and are delivered to an imaging readout 108 for measurement of arrival time and two-dimensional arrival location at the detector plane. In some embodiments, the detector system 109 may exclude the microchannel plate 106 and provide direct particle detection by a suitable imaging readout 108. As further discussed below, in some arrangements, the input stream 110 of particles can comprise neutral and/or ionic forms of atomic and/or molecular species in the ionosphere-thermosphere. The sensor 100 may be mounted to a spacecraft that moves rapidly through the ionosphere-thermosphere such that, from the reference frame of the sensor 100, the particles have high velocities.

Each of FIGS. 1 and 2 is provided with a legend of mutually perpendicular x, y, and z axes to facilitate the present discussion, and directional terms (e.g., vertical, front, back, upper, lower) may be used relative to the illustrated orientation of the sensor 100. However, the use of such axes and directional terms is not intended to limit the possible orientations of the sensor 100. Moreover, additional sensors are discussed further below with which differently oriented reference axes are provided.

With reference primarily to FIG. 1, in the illustrated embodiment, the sensor 100 includes an ionizer 120 that is at least partially defined by a front wall 122, an upper wall 124, a lower wall 126, and two sidewalls 128. To permit viewing into the ionizer 120, only one of the sidewalls 128 is illustrated. As shown in FIG. 1, a rearward boundary of the ionizer 120 can be defined by a front wall 130 of the electrostatic deflector 104.

The front wall 122 of the ionizer 120 includes an opening 132 through which particles can be admitted into the sensor 100, and the front wall 130 of the electrostatic deflector 104 includes an opening 134 through which particles can be admitted into the electrostatic deflector 104. The initial opening 132 may be referred to as a "pinhole" opening, and an area defined thereby can be substantially smaller than an area defined by the internal opening 134. The size of the pinhole opening 132 can be related to the size of an active area of the detector system 109. For example, in some arrangements, a dimension (e.g., diameter) of the pinhole opening 132 can correlate to an identically directed dimension (e.g., height, width) of an active region of the detector system 109. In various embodiments, a dimension of the pinhole opening 132 can be within a range of from about 10% to about 15%, or can be no greater than about 5%, 10%, or 15%, of a corresponding dimension of an active region of the detector system 109. In some embodiments, a diameter of the pinhole opening 132 is within a range of from about 0.05 millimeters to about 5 millimeters, or is no greater than about 1, 2, 3, 4, or 5 millimeters.

The internal opening 134 can serve to select only a sample of particles that have been admitted into the ionizer 120 through the initial opening 132. The internal opening 134 is elongated in the x direction so as to define a slit. The internal opening 134 cooperates with the initial opening 132 to permit only a substantially planar sample of particles into the electrostatic deflector 104. Stated otherwise, the initial opening 132 and the internal opening 134 can cooperate to obtain a sample of particles that travel substantially parallel to the xz plane, with the internal opening 134 functioning as a collimator. In some embodiments, a height of the internal opening 134 is substantially the same as a height of the initial pinhole opening 132. As with the pinhole opening 132, a height of the internal opening 134 can be related to a height of an active area of the detector system 109. In various embodiments, a height of the internal opening 134 can be within a range of from about 10% to about 15%, or can be no greater than about 5%, 10%, or 15%, of a height of an active region of the detector system 109. In some embodiments, a height of the internal opening 134 is within a range of from about 0.05 millimeters to about 5 millimeters, or is no greater than about 1, 2, 3, 4, or 5 millimeters. In various illustrative embodiments, a width of the elongated opening 134 can be within a range of from about 10 millimeters to about 50 millimeters.

The aperture system 102 can include both the initial opening 132 and the internal opening 134. As shown in FIG. 2, the aperture system 102 defines a field of view 137 of the sensor 100. For the initial opening 132 of the illustrated sensor 100, the acceptance angle 136 is relatively broad and can be generally conical. In various embodiments, the acceptance angle 136 can extend outwardly from the initial opening 132 at an angle that is within a range of no less than about 90, 100, 110, 120, or 130 degrees (i.e., no less than about ±45, ±50, ±55, ±60, or ±65 degrees relative to a centerline). As previously discussed, the internal opening 134 cooperates with the initial opening 132 to limit the field of view 137 to a substantially planar portion of the acceptance angle 136. The field of view 137, or collimated portion of the acceptance angle 136, thus may be more triangular or fan-like in shape than conical and may extend along a plane that is parallel to the xz plane. An outwardly projecting angle of the triangularly shaped field of view 137 thus can be within the ranges of angles previously discussed.

The illustrated sensor 100 includes a deflector system 140, which can be employed to extract ionized particles from the particle stream 110 before the stream passes through the initial opening 132. Stated otherwise, the deflector system 140 can prevent ionized particles from entering the sensor 100. The deflector system 140 includes an upper plate 142 and a lower plate 144 that can be provided with a voltage difference. For example, in some embodiments, one of the upper and lower plates 142, 144 can be held at approximately +30 volts and the other of plate can be held at approximately −30 volts. Other suitable arrangements and voltage values for the deflector system 140 are also possible. For example, in some embodiments, the deflector system 140 can comprise one or more semi-transparent wire meshes that induce ion transmission losses. Such an arrangement can be substantially void of "blind spots," such that the field of view 136 extends from the initial opening 132 at ±90 degrees relative to a centerline.

The illustrated sensor 100 further includes an electron emission source 150 that is configured to impart a charge to neutral particles before they pass through the internal opening 134. The electron emission source 150 can operate on principles of electron impact ionization, which are known in the art. The electron emission source 150 can comprise any suitable device, such as, for example, one or more field emission cathodes (e.g., a field emission cathode array) or thermionic emission cathodes (e.g., heated filaments, heated low work function surfaces or the like). The illustrated electron emission source 150 is positioned at or near the lower wall 126 of the ionizer 120, and is configured to direct a sheet of electrons 153 (FIG. 2) vertically toward the upper wall 124. A Faraday cup 152 or other suitable device may be included at or near the upper wall 124 to receive the sheet of electrons 153. Confinement and focusing methods may be used to control the spatial extent of the electron sheet.

In other embodiments, the electron emission source 150 can be positioned closer to the incoming stream of neutral particles, which can reduce or prevent expansion of the electron sheet 153. In certain of such embodiments, the lower wall 126 likewise can be moved to a position that is closer to the particle stream. In other embodiments, a support structure and electrical connections for the electron emission source 150 can be positioned in the increased space between the lower wall 126 and the electron emission source 150.

The illustrated electrostatic deflector 104 includes an upper wall 154, a lower wall 156, and two sidewalls 158. To permit viewing into the electrostatic deflector 104, only one of the sidewalls 158 is illustrated. The upper and lower walls 154, 156 can comprise any suitable material for generating an electric field 159 (FIG. 2) therebetween. For example, the upper and lower walls 154, 156 can comprise parallel upper and lower metallic plates 162, 164, respectively, that are each held at a different potential value, and the electric field 159 can be directed substantially parallel to the y axis (e.g., in the negative y direction). The potential values on the plates can vary depending on their geometries. For example, larger potential differences may be used when the plates are spaced further apart, whereas smaller potential differences may be used where the plates are longer (as charged particles can spend a longer time in the deflection field). In various embodiments, the upper plate 162 can be held at a potential within a range of from about 0.2 volts to about 15 volts, and the lower plate 164 can be held at ground. Of course, the upper plate 162 may be held at ground and a negative potential can be applied to the lower plate 164. More generally, a potential difference between the upper and lower plates 162, 164 can be within a range of from about 0.2 volts to about 15 volts.

In the illustrated embodiment, the upper and lower plates 162, 164 are substantially rectangular. In various embodiments, a length of each plate 162, 164 can be within a range of from about 20 millimeters to about 50 millimeters, can be no less than about 20, 30, 40, or 50 millimeters, or can be no greater than about 20, 30, 40, or 50 millimeters; a width of each plate 162, 164 can be within a range of from about 20 millimeters to about 50 millimeters, can be no less than about 20, 30, 40, or 50 millimeters, or can be no greater than about 20, 30, 40, or 50 millimeters; and a distance between the plates can be within a range of from about 20 millimeters to about 70 millimeters, can be no less than about 20, 30, 40, 50, 60, or 70 millimeters, or can be no greater than about 20, 30, 40, 50, 60, or 70 millimeters. Other arrangements of the plates 162, 164 are also possible.

In some embodiments, the front wall 130 and the sidewalls 158 can be configured to provide a substantially uniform electric field 159 throughout the electrostatic deflector 104, such that an electric force that acts on a charged particle is substantially the same at any position within the volume of space defined by the front wall 130, the upper and lower walls 154, 156, and the sidewalls 158. For example, the front wall 130 and the sidewalls 158 can reduce fringing effects at or near the borders of the upper and lower plates 162, 164. In some embodiments, the front wall 130 and the sidewalls 158 are held at multiple voltages, the values of which can decrease from the upper plate 162 to the lower plate 164. For example, in some embodiments, the voltage values of the front wall 130 and the sidewalls 158 decrease substantially linearly with vertical position in the direction from the upper plate 162 to the lower plate 164. Various suitable embodiments of the front wall 130 and the sidewalls 158 are described below with respect to FIGS. 9-11.

The electrostatic deflector 104 can further include a screen 166, such as a wire mesh or grid. In the illustrated embodiment, the screen 166 includes a series of horizontal wires 168 arranged in a grid pattern. The screen 166 likewise can assist in maintaining the electric field 159 substantially constant throughout the electrostatic deflector 104 (e.g., within the volume of space defined by the front wall 130, the upper and lower walls 154, 156, the sidewalls 158, and the screen 166). For example, one or more of the wires 168 can be maintained at different voltages. In some embodiments, the voltage on the wires 168 decreases substantially linearly with vertical position in the direction from the upper plate 162 to the lower plate 164. More generally, in some embodiments, voltages on the wires 168 correspond with voltages of the sidewalls 158, which may decrease in any suitable manner from the upper wall 154 toward the lower wall 156.

The screen 166 can define a relatively small surface area so as to permit a large fraction of particles to exit the electrostatic deflector 104 through an output end thereof. For example, an outer periphery of the output end of the electrostatic deflector 104 can define a transverse area 170 that is substantially parallel to the xY plane. The screen 166 can extend through the transverse area 170 such that the wires 168 block portions of the transverse area 170, while spaces between adjacent wires 168 provide open passages through which particles can exit from the electrostatic deflector 104. The exiting particles can be provided directly to the microchannel plate 106. Stated otherwise, the open portions of the transverse area 170 are in direct communication with the microchannel plate 106. In the illustrated embodiment, output from the electrostatic deflector 104 is not constrained, filtered, or sampled, but rather, is provided to the microchannel plate 106 in a substantially undiminished form. In various embodiments, the open portions of the transverse area 170 account for no less than about 50, 60, 70, 75, 80, 85, 90, or 95 percent of the total transverse area 170.

The microchannel plate 106 can be of any suitable variety, including those known in the art and those yet to be devised. The microchannel plate 106 can be configured to amplify single ion events (e.g., arrival of individual ions thereat). The microchannel plate 106 can include an input end 172 and an output end 174, and an array of channels 176 can extend between the input and output ends 172, 174. Each channel 176 can be configured to receive a charged particle from the electrostatic deflector 104 and, as is known in the art, can convert the receipt of a charged particle into a pulse of electrons that is confined to the channel 176. A large electric field can be provided between the input and output ends 172, 174 of the microchannel plate 106. For example, in some embodiments, a potential difference between the input and output ends 172, 174 can be within a range of from about 1,500 volts to about 6,000 volts. The electric field also can extend beyond the input end 172 so as to accelerate charged particles toward the microchannel plate 106. Accordingly, in some embodiments, the screen 166 can shield the interior of the electrostatic deflector 104 from the electric fields generated by the microchannel plate 106.

The imaging readout 108 can be positioned at the output end 174 of the microchannel plate 106. The imaging readout 108 can be configured to sense, register, convert, or measure electron pulses that are delivered thereto by the microchannel plate 106. In the illustrated embodiment, the imaging readout 108 comprises an array 178 of anodes 180 that are responsive to the electron pulses. The anode array 178 can extend in two dimensions so as to define a large measurement area, which can be responsive to the full portion of the transverse area 170 of the electrostatic deflector 104 that is in direct communication with the microchannel plate 106. The illustrated anode array 178 is substantially planar and is substantially parallel to the xy plane. The anodes 180 in the array 178 are arranged in a series of adjacent rows 182 and adjacent columns 184. Although the anodes 180 are schematically depicted in FIG. 1 as individual, generally circular devices, it will be appreciated that other suitable arrangements for the anodes 180 are possible. For example, in some embodiments, the anodes can comprise delay lines arranged in serpentine, helical, or crossed patterns.

In certain embodiments, a suitable arrangement of the detector system 109 can include a microchannel plate (MCP) detector device that has a cross delay line (XDL) anode readout. Other types of imaging readout technologies that may be used with a microchannel plate include resistive anodes, wedge-and-strip anodes, segmented anodes, discrete anodes, Vernier anodes, cross-strip anodes, application specific integrate circuit (ASIC) arrays, phosphor screens, intensified charge-coupled devices (CCD), and charge injection devices. In various embodiments, the imaging readout 108 can operate in a pulse counting mode or in an analog current collection mode. In some embodiments, the detector system may provide direct particle detection by an imaging readout, such as a delta-doped CCD or CMOS-based active pixel sensor, without requiring a microchannel plate for charge amplification.

Embodiments of the imaging readout 108 listed above can comprise current-collection anodes for measurement of the electron pulses produced by the microchannel plate. In other embodiments however, the imaging readout 108 can convert the electron pulses to photons for direct imaging; for example, using a phosphor screen coupled with a CCD camera. Such an arrangement can provide excellent spatial resolution and dynamic range, but may have reduced detection limits. Depending on the application, it may be desirable for the detector system 109 to have high spatial resolution, be capable of pulse-counting, have a high maximum count rate over a large dynamic range, have low power consumption, be low in cost, and/or have simple electronics.

With reference to FIG. 2, illustrative operational modes of the sensor 100 will now be described. In certain embodiments, the sensor 100 may be selectively transitioned between any of the operational modes. In one operational mode, the particle stream 110 passes between the deflector plates 142, 144 of the deflector system 140 and enters the sensor 100 through the initial opening 132 at a high velocity relative thereto. For example, the sensor 100 may be mounted to a 3-axis stabilized satellite (not shown) that moves through the ionosphere-thermosphere in the ram direction, which corresponds with the negative z direction for the illustrated orientation. The particle stream 110 thus represents a sample of the atmospheric particles through which the sensor 100 travels.

Where it is desired to only measure properties of neutral particles, the deflector plates 142, 144 may be charged so as to eliminate ions from the particle stream 110 before the stream enters the sensor 100. Once within the ionizer 120, the stream 110 of neutral particles encounters the sheet of electrons 153 generated by the electron emission source 150. At least a fraction of the neutral particles thereby obtain a single positive charge. The particle stream 110 continues toward the interior opening 134. Due to the slit-like configuration of the opening 134, only a portion of the particle stream 110 is permitted to continue through the opening 134 and into the electrostatic deflector 104. As previously discussed, the particles that enter the electrostatic deflector 104 are those whose movement up to the opening 134 has generally been constrained to a plane parallel to the xz plane.

Once the charged particles enter the electrostatic deflector 104, they encounter the electric field 159, which is directed parallel to the y axis. Each charged particle thus is provided with an equal displacement force in the y direction while within the electrostatic deflector 104, without any such displacement forces in the x or z directions. The charged particles thus maintain their original velocities in the x and/or z directions while being accelerated and displaced in the y direction. The amount if displacement in the y direction varies according to the z-component of the kinetic energy of each particle. The particles thus are separated along the y direction according to their various energies. Stated otherwise, the electrostatic deflector 104 can cause an energy dispersion of the particles. In certain embodiments, a high orbital velocity of a spacecraft to which the sensor 100 may be mounted, as compared with neutral thermal velocities, can allow key atmospheric constituents (e.g., O and $N_2$) to be separated from each other by energy analysis.

FIG. 2 illustrates the separation of three different species of particles. The most energetic species is deflected the least, and the least energetic species is deflected the most. The separated particles continue through the open portions of the screen 166 at the output end of the electrostatic deflector 104 and into the microchannel plate 106. Pulses representative of each particle detection event are then delivered to a portion of the imaging readout 108 that corresponds to the spatial orientation along the xy plane at which the particle was delivered to the microchannel plate 106. Spatial and temporal arrival information from the imaging readout 108 can then be delivered to any suitable destination, as depicted at the arrow 190. For example, the information may be stored and/or processed onboard the spacecraft and/or may be downlinked for storage and processing. As discussed further below, an integrated series of readout measurements can yield a two-dimensional plot such as that shown in FIG. 3A.

Throughout a measurement cycle, the electric field 159 of the electrostatic deflector 104 can be held at a substantially constant level. Accordingly, the sensor 100 can obtain a full set of measurements of different species within a given particle stream 110 without scanning through different energy levels at the electrostatic deflector 104 (e.g., via modulation of the voltage difference between the plates 162, 164) and, correspondingly, without screening out particles that do not correspond with each scanned energy level. The sensor 100 thus can have a high duty cycle (e.g., up to and including 100%). Energies of the separated particles can be determined from their displacement along the y direction. Moreover, the sensor 100 can be highly sensitive, as any particle that is passed through the electrostatic deflector 104 is transmitted to the microchannel plate 106 and has a high probability of being registered by the detector system 109. Embodiments of the sensor 100 thus can be energy efficient, provide high accuracy, and/or be suitable for use in highly rarefied portions of the atmosphere.

As previously mentioned, in some operational modes, the sensor 100 can operate in an analog mode in which current measurements are obtained via the imaging readout 109. While such an operational mode can allow a high dynamic range, it can be of less use in conditions of very low neutral flux where electronic noise can dominate. In other operational modes, the sensor 100 uses pulse-counting ion detection, which can be virtually free of electronic noise. Additionally, high ion count rates can be achieved in a pulse-counting mode; for example, individual ions may be counted at rates of up to about 500,000 per second. Furthermore, in some embodiments, the electron emission source 150 utilizes a field emission cathode array, which allows very precise control of the emission current and, therefore, of the ion flux into the electrostatic deflector 104. This feature can be used as a gain control mechanism during periods of high neutral flux through the initial opening 132, further expanding the overall dynamic range of the sensor 100 (e.g., by several orders of magnitude). A combination of high throughput, large dynamic range, and/or high-resolution spatial detection of individual ions can allow neutral wind measurements at higher altitudes and in colder, more rarified atmospheric conditions than current technology allows. Under any atmospheric conditions, embodiments of the sensor 100 allow fast, very accurate determination of the neutral velocity distribution and of the thermospheric parameters derived therefrom.

The sensor 100 can function in an operational mode in which it is desired only to measure the properties of ions that enter the sensor 100, and not neutral particles. In this mode, the deflector system 140 is inactive (e.g., the plates 142, 144 are at the same potential), and the electron emission source 150 is not used. The ions are received into the sensor 100 via the initial opening 132, are passed through the electrostatic deflector 104, and are registered by the detector system 109 in manners such as described above. In some instances, neutral particles may also be admitted into the electrostatic deflector 104, but they are unaffected by the electric field 159 and do not lead to a registration event when passed to the microchannel plate 106. A single sensor 100 thus can be used to obtain separate measurements of the thermosphere and the ionosphere by selectively turning the deflector system 140 and the electron emission source 150 on and off, respectively.

Other or further operational modes of the sensor 100 can be used to target specific properties of the atmosphere. For example, one operational mode may be used to determine a total local density of the atmosphere. In such an operational mode, the electrostatic deflector 104 would operate at a very low voltage (e.g., less than 1 volt) such that all species would be permitted through the output end of the deflector and delivered to the microchannel plate 106. In such an operational mode, even the lighter species, such as hydrogen and helium, would trigger ion events at the microchannel plate 106.

In another operational mode, a stronger deflection potential can be applied to the electrostatic deflector 104. This mode can provide for an increased resolution of relatively heavier species, such as, for example, molecular nitrogen and atomic oxygen. More focused observation of such heavier species can yield more accurate determination of the total neutral wind vector or total ion drift vector.

Figure 3A:
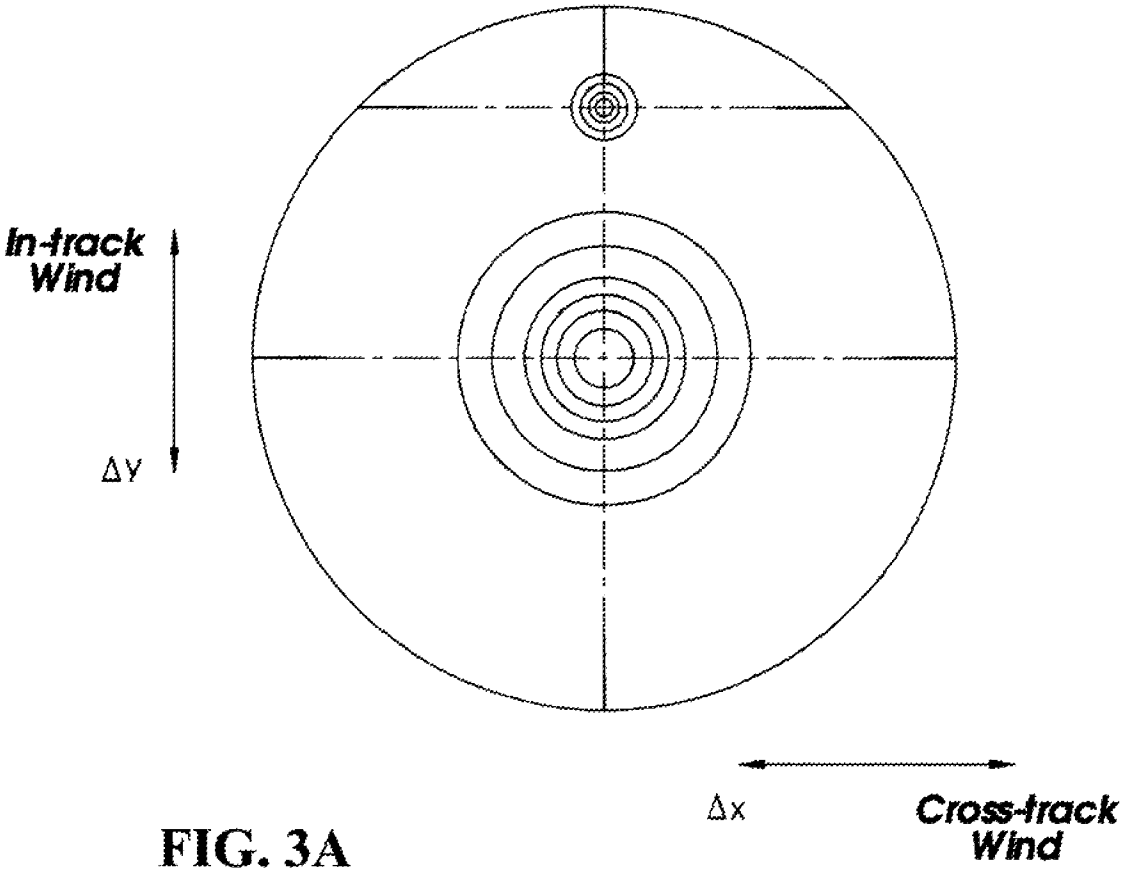
FIG. 3A is a depiction of a plot that may be obtained via the sensor of FIG. 1, which provides a spatial representation of measurement events and uses different colors or shades to indicate the number of such events at each position.

FIG. 3A illustrates a plot that can be obtained using the sensor 100 in a mode such as just described. Each position on the plot corresponds with a location on the two-dimensional anode array 178. The illustrated plot corresponds to data that could be obtained in a low Earth orbit with the atmosphere at about 700 K, and with the electrostatic deflector 104 operating at a relatively high deflection potential. The plot is an intensity plot that indicates the number of collection events that transpired at each location over a given period, or stated otherwise, represents an integration of a series of collection events, where the shade at each position indicates the number of collection events that transpired thereat.

Information regarding the sampled portion of the atmosphere can be obtained from the plotted data. For example, the composition, density, temperature, neutral wind (or ion drift) properties of the sample can be determined. As indicated by the double-headed arrows, wind properties in the in-track direction (i.e., z direction) can be determined, at least in part, from the displacement of particles in the y direction on the plot; and wind properties in the cross-track direction (i.e., x direction) can be determined, at least in part, from the displacement of particles in the x direction on the plot. As further discussed below, in some embodiments, more complete information regarding the properties of the sampled atmosphere (e.g., the wind or drift vectors) can be obtained when an additional sensor that is rotated 90 degrees about the z axis is used alongside the sensor 100.

Figure 3C:
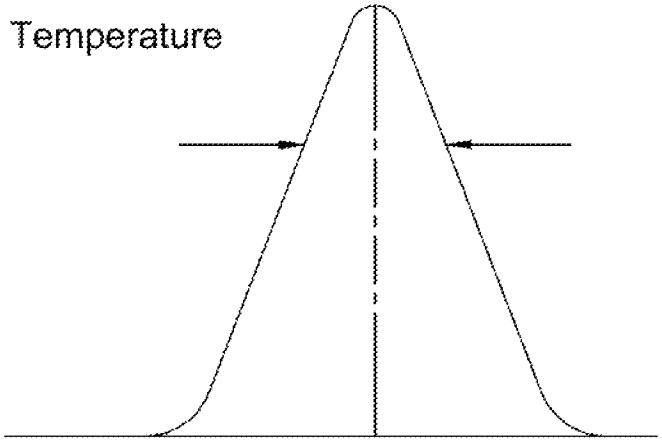
FIG. 3C is a depiction of a plot that may be obtained via the sensor of FIG. 1, which illustrates the number of measurement events as a function of position along the x axis.
Figure 3B:
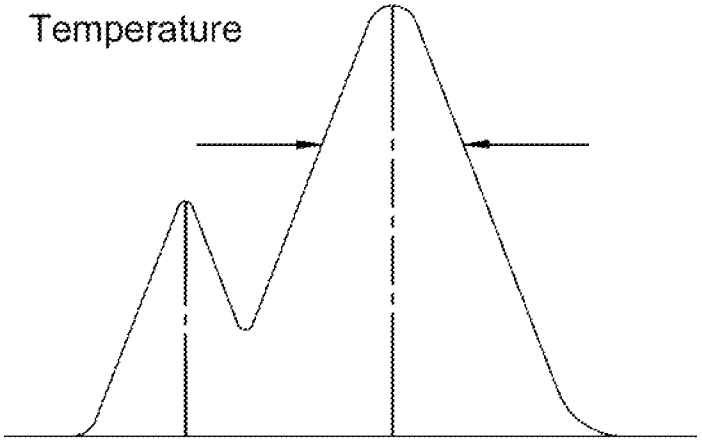
FIG. 3B is a depiction of a plot that may be obtained via the sensor of FIG. 1, which illustrates the number of measurement events as a function of position along the y axis.

FIG. 3B illustrates another plot of the same data that was used to generate the plot in FIG. 3A. The y axis is shown in a horizontal configuration, with the leftmost end thereof corresponding to the topmost point on the plot in FIG. 3A. Each peak can correspond to a different molecular species. The smaller peak corresponds with molecular nitrogen, and the larger peak corresponds with atomic oxygen. As is known in the art, the density of each species can be determined from their respective total number of counts, and the temperature can be determined from a width of the distribution of each molecular species, which is indicated by the inwardly pointing horizontal arrows.

FIG. 3C illustrates another plot of the same data that was used to generate the plots in FIGS. 3A and 3B, respectively. The total density and overall temperature can readily be calculated from the plotted information.

Figure 4:
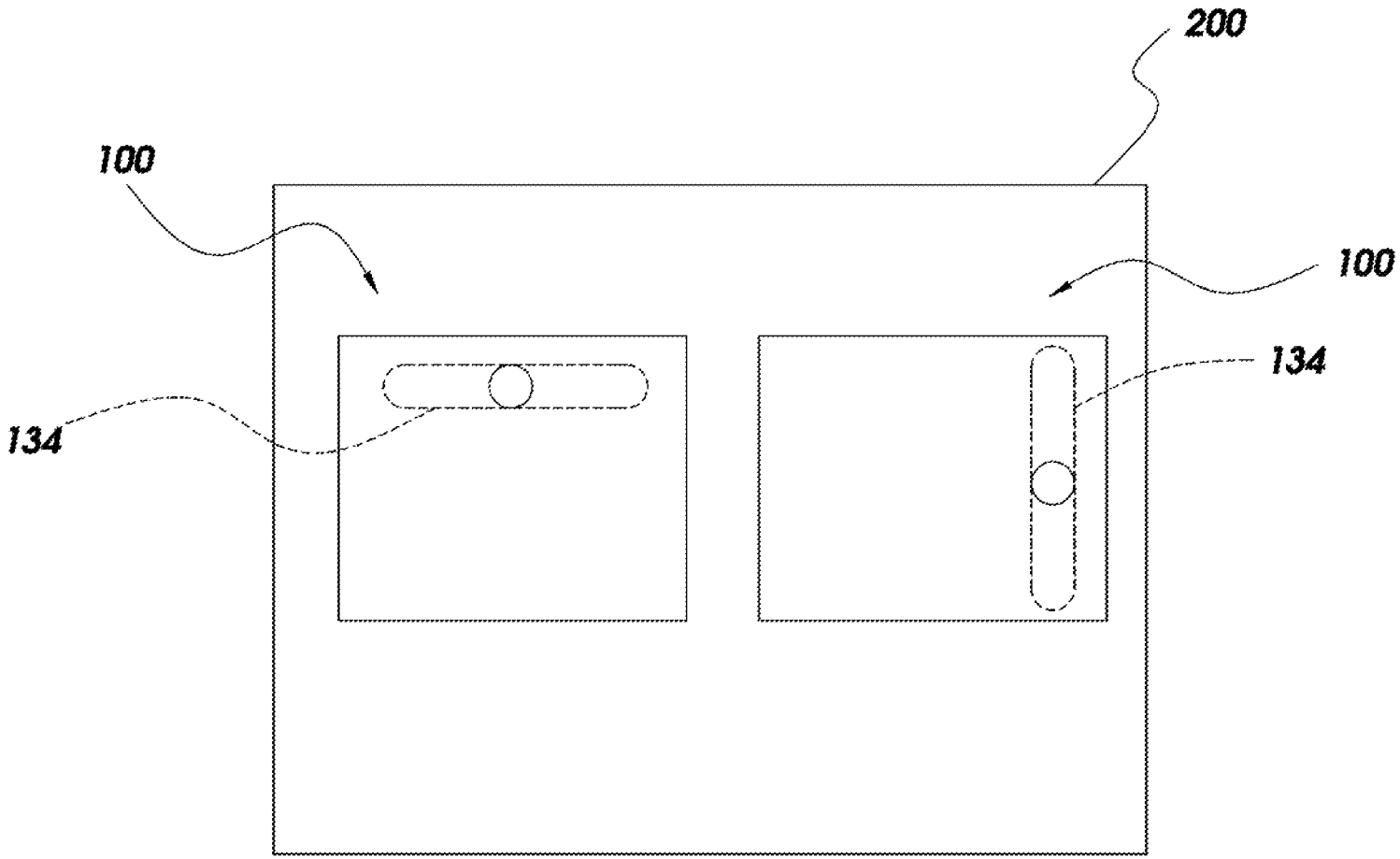
FIG. 4 is a schematic front elevation view of an embodiment of a spacecraft that includes embodiments of two sensors that are oriented orthogonally to each other.

FIG. 4 illustrates an embodiment of a spacecraft 200 with which multiple sensors 100 can be used. The illustrated spacecraft 200 is a 3-axis stabilized satellite, and the front face of the satellite (relative to the ram direction) is shown. The spacecraft 200 includes a first sensor 100 that is oriented substantially as described above with respect to FIGS. 1 and 2. The spacecraft 200 further includes a second sensor 100 that is rotated 90 degrees relative to the first sensor 100 such that the internal openings 134 (shown in phantom) extend in orthogonal directions. Each sensor 100 can operate in any of the manners described above. In some instances, the data collected by both sensors 100 can be used to obtain a more complete understanding of certain properties of the sampled atmosphere than might be obtained from just a single sensor 100.

Figure 5:
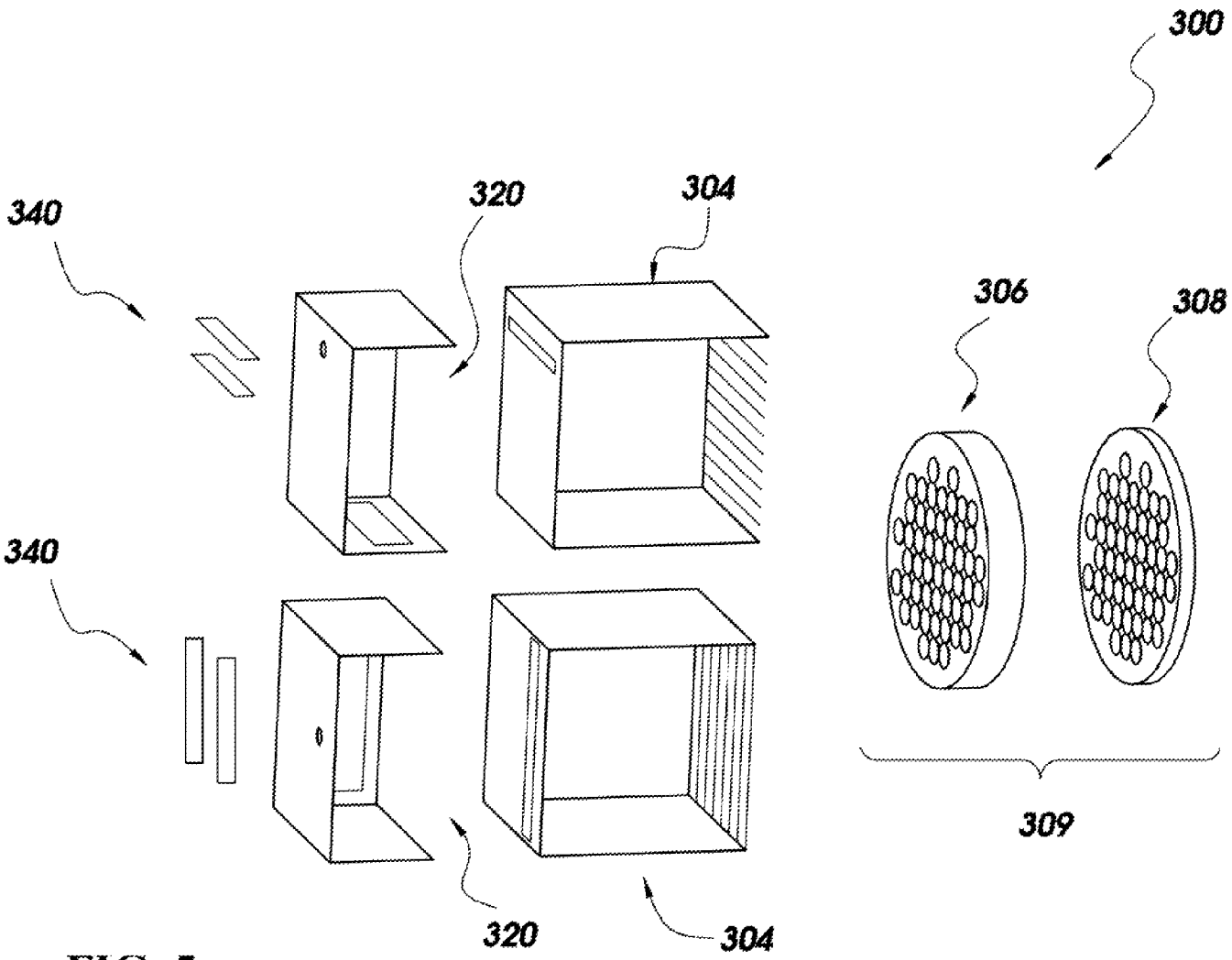
FIG. 5 is a schematic exploded, cutaway, perspective view of another embodiment of a sensor, which includes two energy dispersion units that are oriented orthogonally to each other and that share a common detector system.

FIG. 5 illustrates another embodiment of a sensor 300, which can resemble the sensor 100 described above in certain respects. Accordingly, like features are designated with like reference numerals, with the leading digits incremented to "3." Relevant disclosure set forth above regarding similarly identified features thus may not be repeated hereafter. Moreover, specific features of the sensor 300 may not be shown or identified by reference numerals in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the sensor 300. Any suitable combination of the features and variations of the same described with respect to the sensor 100 can be employed with the sensor 300, and vice versa. This pattern of disclosure applies equally to further embodiments depicted in subsequent figures and described hereafter.

The sensor 300 can include two sets of deflector systems 340, ionizers 320, and electrostatic deflectors 304, which can define substantially orthogonal orientations relative to each other. The sensor 300 can include a detector system 309 comprising a microchannel plate 306 and imaging readout 308. In the assembled sensor 300, the outputs of the electrostatic deflectors 304 are each provided to separate portions of the microchannel plate 306. Use of the sensor 300 thus can include sampling incoming neutrals in two mutually perpendicular planes, ionizing each planar stream by electron impact, and measuring the full 3D neutral velocity distribution by dispersive energy analysis and high-resolution 2D imaging detection. Use of a single detector system 309 in the sensor 300 can reduce the overall mass and power consumption of the sensor 300.

Figure 6:
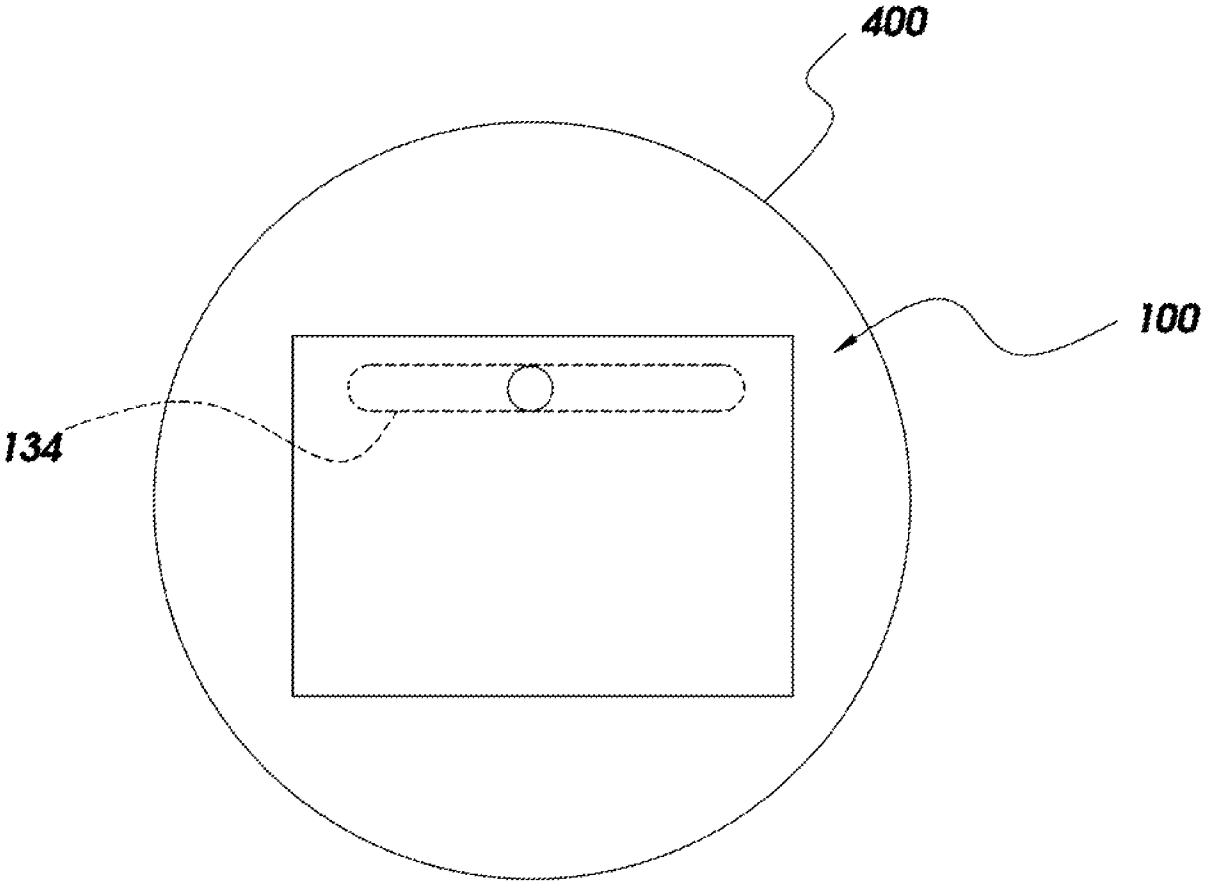
FIG. 6 is a schematic front elevation view of another embodiment of a spacecraft that includes an embodiment of a sensor.

FIG. 6 illustrates another embodiment of a spacecraft 400, which may be an orbiting satellite. In operation, the spacecraft 400 spins about an axis that is aligned with its ram direction. The spacecraft 400 includes a sensor 100, and data obtained by the sensor 100 can be sufficient to reconstruct a full three-dimensional understanding of a wind vector or an ion drift vector. This may be accomplished as the sampling plane of the sensor 100 continuously and repeatedly rotates through a full 360 degrees (e.g., due to rotation of an internal opening 134). Time-dependent imaging data obtained by the sensor 100 can be correlated with the rotational orientation of the spacecraft 400 for purposes of processing the data.

In other embodiments, the ram direction of the spacecraft 400 extends perpendicularly to the page in FIG. 6, and the spacecraft 400 rotates about an axis that is parallel to the direction of elongation of the illustrated internal opening 134. The sensor 100 thus can sample a large swath of the atmosphere as the spacecraft 400 rotates, and time-dependent imaging data obtained by the sensor 100 can be correlated with the rotational orientation of the spacecraft 400 for purposes of processing the data. Other rotational configurations of the spacecraft 400 are also possible and may be correlated with information obtained via the sensor 100 in order to process the data.

Figure 7:
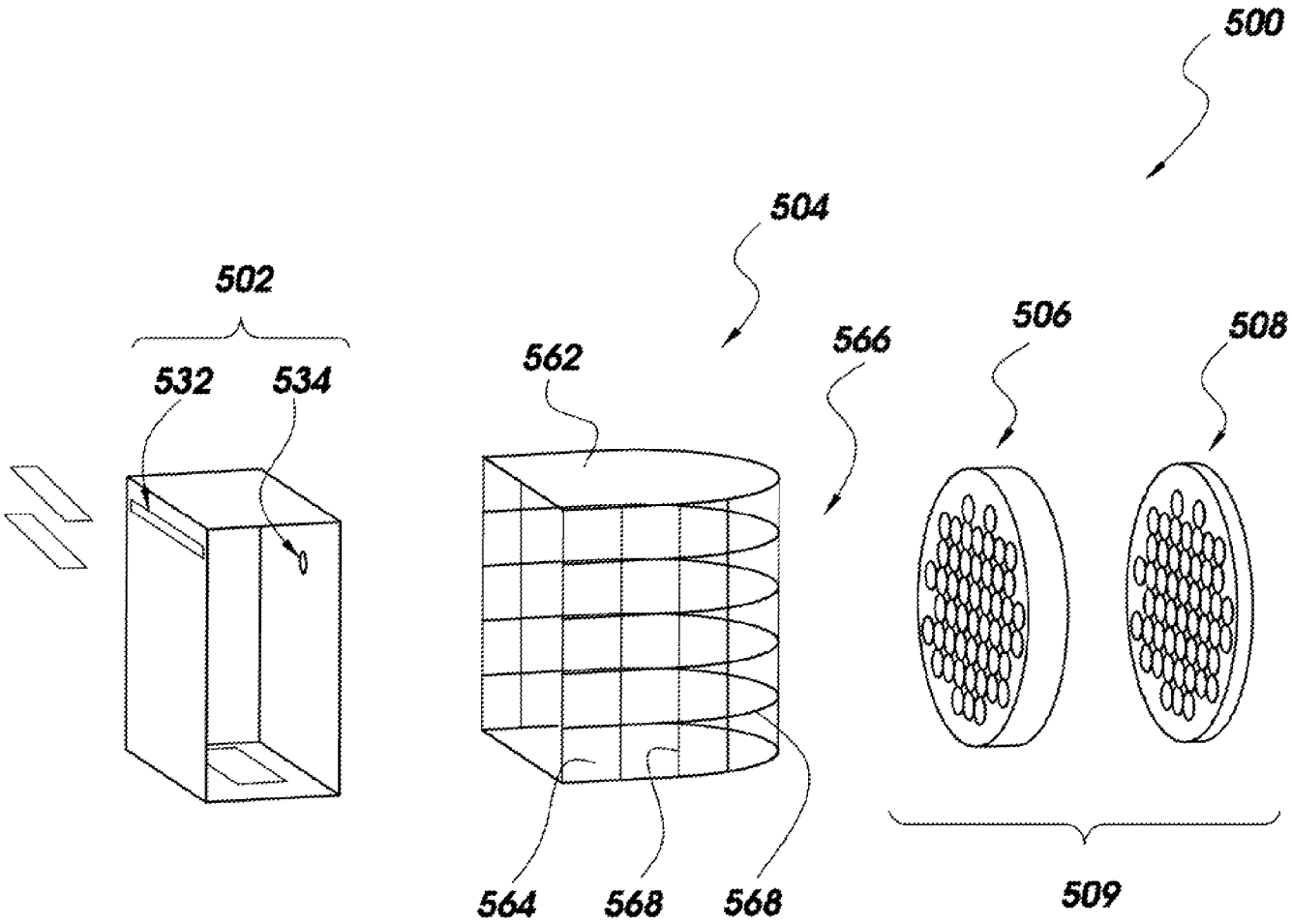
FIG. 7 is a schematic exploded, cutaway, perspective view of another embodiment of a sensor.

FIG. 7 illustrates another embodiment of a sensor 500, such as the sensors 100, 300 described above. The sensor 500 includes an aperture system 502, which includes an initial opening 532 and an internal opening 534. The illustrated initial opening 532 is elongated in the x direction, whereas the internal opening 534 defines a pinhole aperture. The aperture system 502 can function similarly to the aperture system 102 described above.

The sensor 500 further includes an electrostatic deflector 504 that includes an upper plate 562, a lower plate 564, and a screen 566. The upper and lower plates 562, 564 are substantially semi-circular, and the screen 566 borders the arced portion thereof. The screen 566 can be of any suitable variety, such as discussed above, and can desirably provide a large area through which particles can be delivered to a detector system 509, comprising a microchannel plate 506 and imaging readout 508. In the illustrated embodiment, the screen 566 comprises a mesh of wires 568 in which some wires 568 are oriented substantially vertically and other wires 568 are oriented substantially horizontally.

Figure 8:
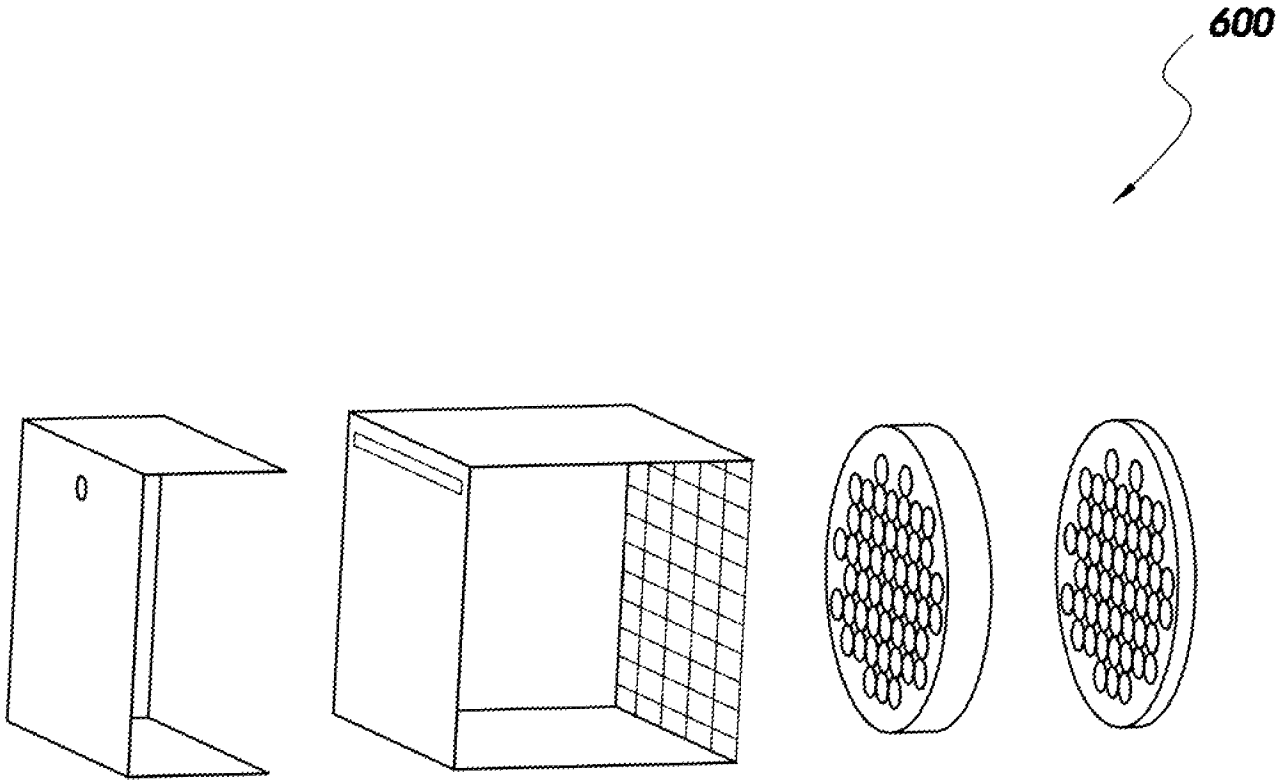
FIG. 8 is a schematic exploded, cutaway, perspective view of another embodiment of a sensor.

FIG. 8 illustrates another embodiment of a sensor 600. In some embodiments, the sensor 600 can be configured to measure properties of the ionosphere alone, and can be devoid of a deflector system and ionizer (as shown).

Figure 9A:
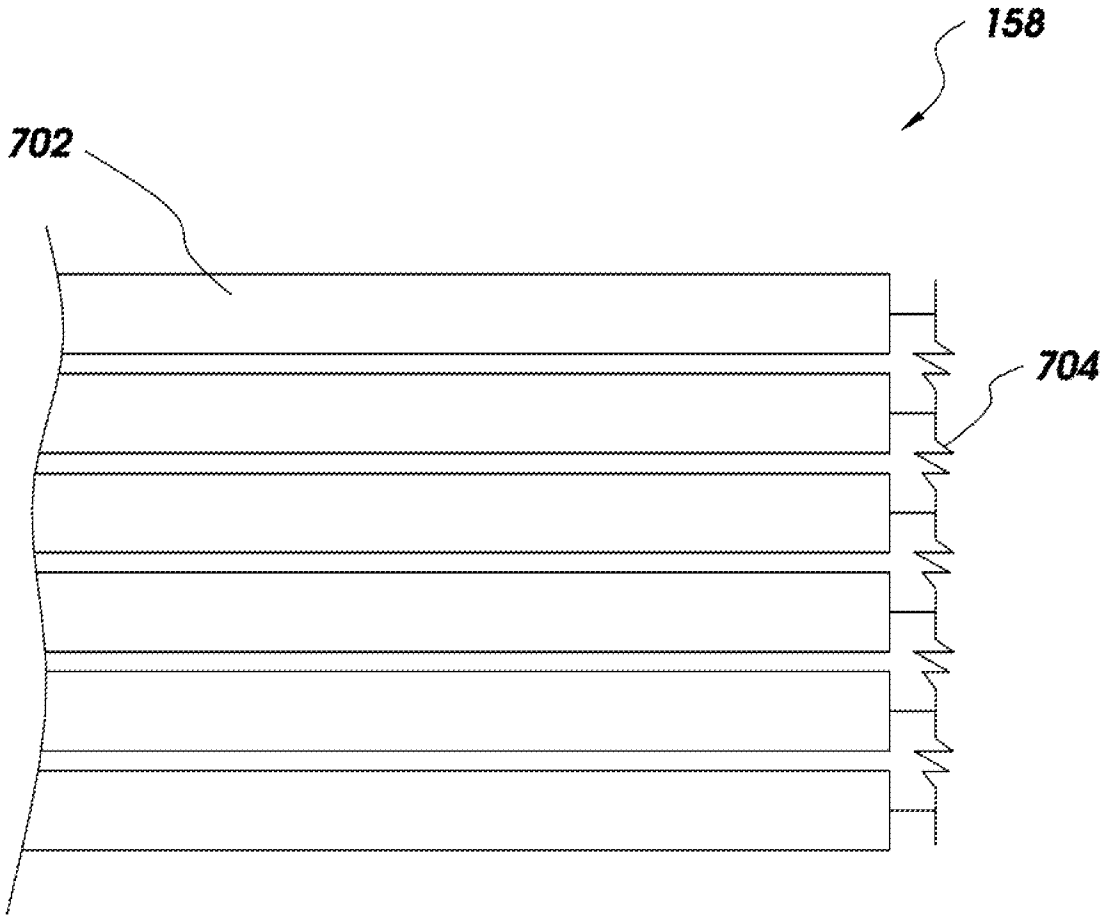
FIG. 9A is a schematic partial elevation view of an embodiment of a sidewall of an electrostatic deflector.

FIG. 9A illustrates an embodiment of a sidewall 158 that is compatible with embodiments of the sensors described herein. The sidewall 158 comprises multiple horizontal metal strips 702 that are each connected to any adjacent metal strips via a separate resistor 704. The horizontally arranged metal strips 702 thus are connected in series with each other in a vertical direction so as to form a multi-level voltage divider. The value of the potential at each strip 702 can decrease in any desired manner by selecting an appropriate resistance between adjacent strips 702. In some embodiments, the voltage of the metal strips 702 decreases linearly in the vertical direction, although other patterns of decreasing voltage are also possible.

Figure 9B:
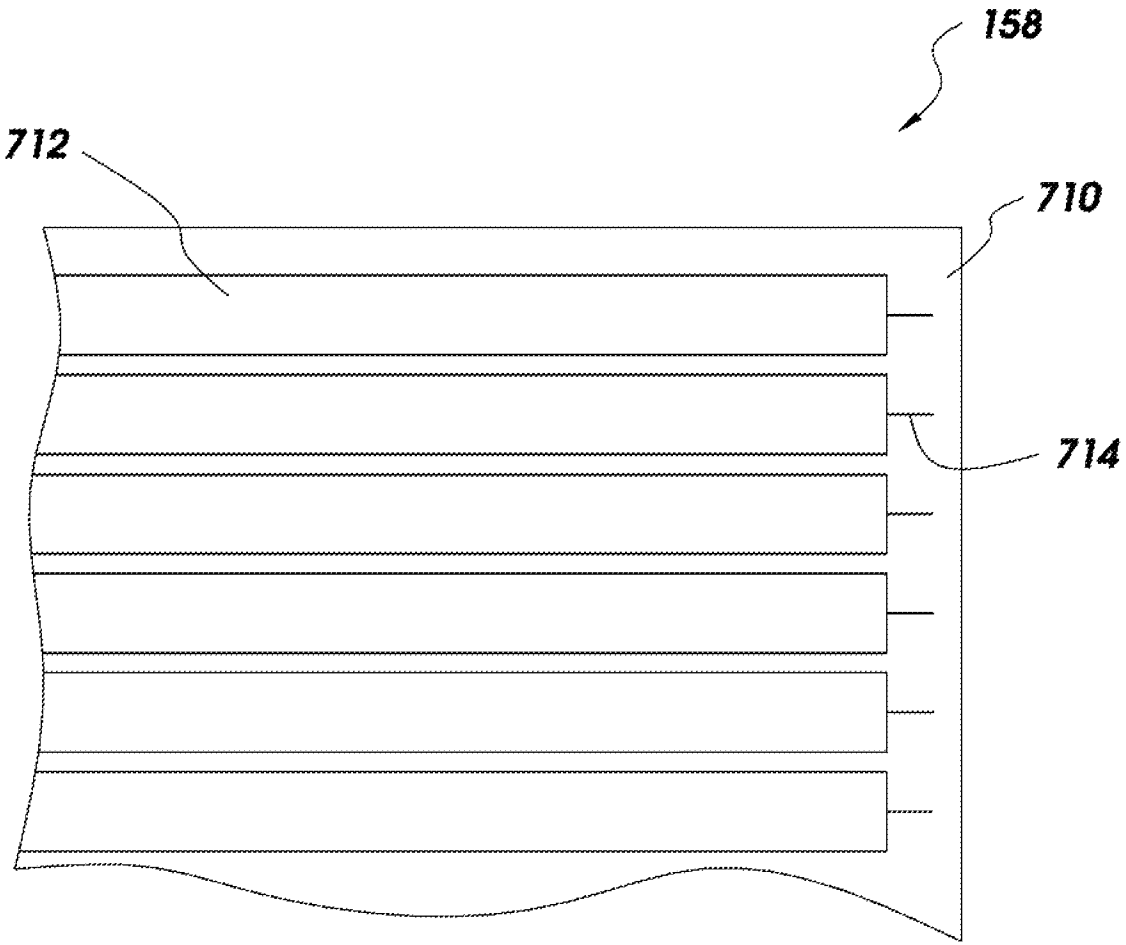
FIG. 9B is a schematic partial elevation view of another embodiment of a sidewall of an electrostatic deflector.

FIG. 9B illustrates another embodiment of a sidewall 158 that is compatible with embodiments of the sensors described herein. The sidewall 158 comprises a printed circuit board 710, which can include a series of tightly packed metal strips 712. A voltage of each metal strip 712 can be controlled via a separate connector or lead 714 in any suitable manner. In some embodiments, a voltage pattern of the sidewall 158 may be variable or adjustable.

Figure 9C:
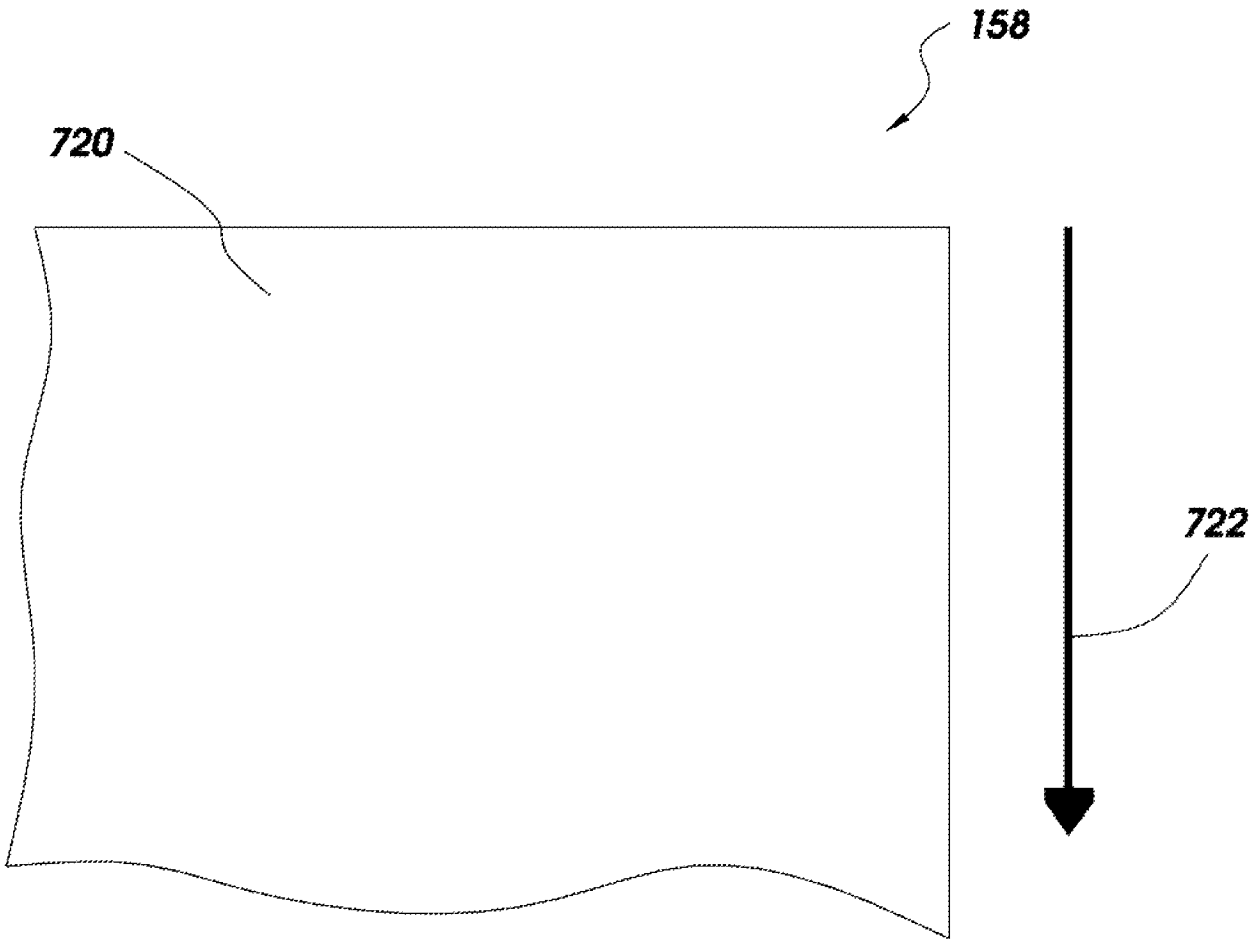
FIG. 9C is a schematic partial elevation view of another embodiment of a sidewall of an electrostatic deflector.

FIG. 9C illustrates another embodiment of a sidewall 158 that is compatible with embodiments of the sensors described herein. The sidewall 158 comprises a sheet of resistive glass 720, which can provide for a decreasing voltage gradient 722.

Figure 10:
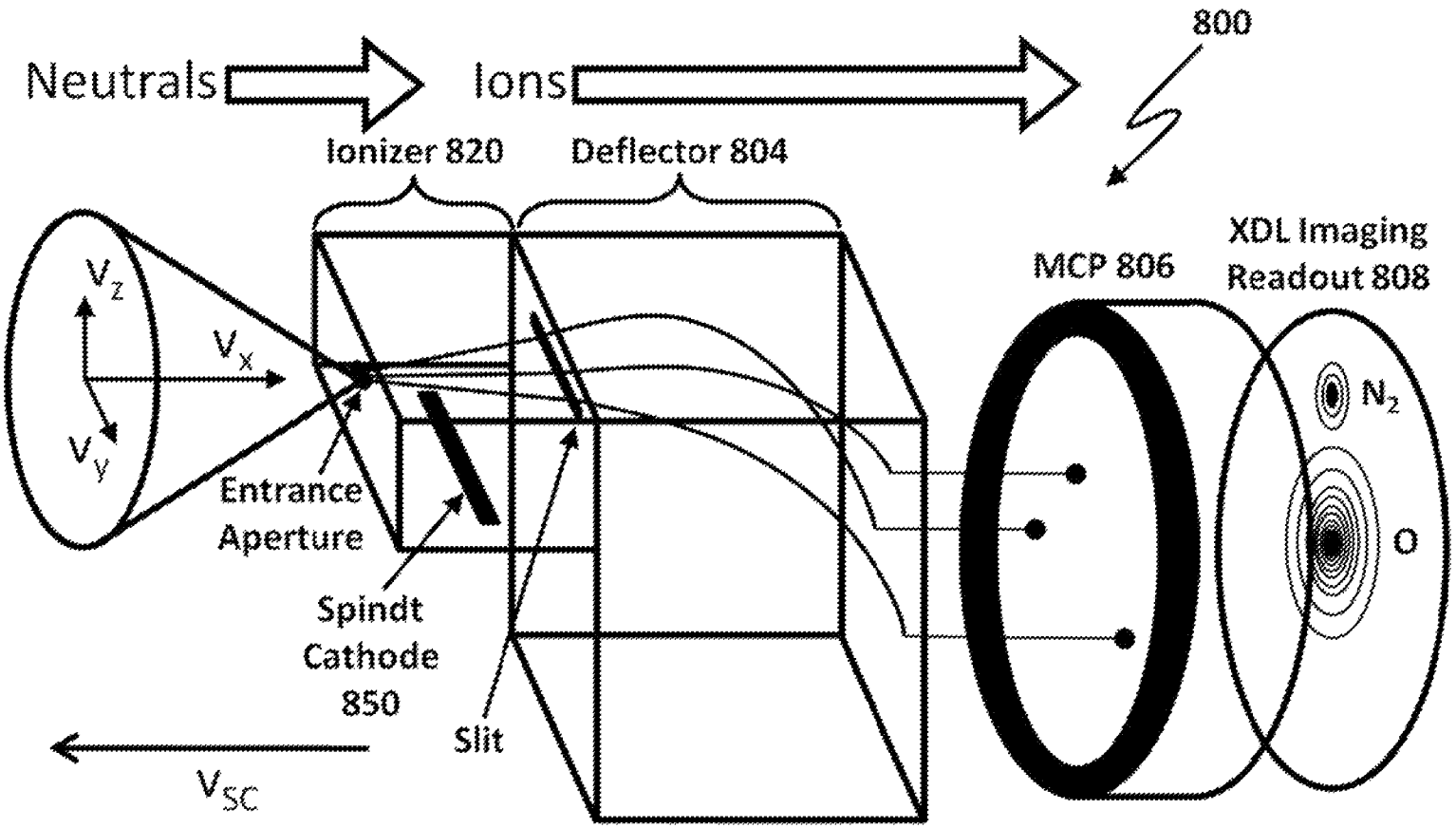
FIG. 10 is a schematic perspective view of another embodiment of a sensor.

FIG. 10 illustrates another embodiment of a sensor 800, which includes an ionizer 820, an electrostatic deflector 804, and a detector system 809 comprising a microchannel plate 806 and an imaging readout 808. The sensor 800 may also be referred to herein as an Imaging Dispersive Energy Analyzer (IDEA). The ionizer 820 includes an electron emission source 850, which comprises a Spindt cathode field emission array or thermionic emission cathode to generate a uniform sheet of electrons. The former can exhibit low-power consumption yet generate high electron current densities for extended periods. In some embodiments, the array can be coupled to emission control electronics for precise gain control of the sensor 800 as a whole.

Embodiments of the Spindt cathode field emission array can include an array of micro-fabricated tips lying in close proximity to a gate electrode so as to generate localized, extremely high electric fields that are capable of extracting electrons into free space without heating (or at least not significantly). Compared to more conventional thermionic emission, this technique can produce higher electron current densities with a fraction of the power consumption. Spindt cathodes exhibit significantly longer lifetimes than do wire filaments in laboratory applications. This robustness can be extended to spacecraft applications by fabricating the cathodes from materials that are designed to resist degradation in an atomic oxygen environment. In some embodiments, the Spindt cathodes comprise molybdenum. In other embodiments, the Spindt cathodes comprise other materials, whether separately or in addition to molybdenum, such that the Spindt cathodes exhibit longer lifetimes in an atomic oxygen environment than do comparative Spindt cathodes that only comprise molybdenum.

Geometries of the Spindt cathodes may be configured to produce desired electron cloud characteristics. For example, Spindt cathodes also can be fabricated in virtually any planar geometry. In various embodiments, the electron emission source 850 utilizes either a rectangular or semi-circular cathode to generate a well-defined sheet of electrons that intersects normally an incoming neutral stream. In some embodiments, the electron emission source 850 includes redundant set of Spindt cathodes. Geometries such as those just described can be well-suited for such redundant configurations, which can effectively eliminate the possibility of ionizer failure on-orbit, regardless of the lifetime of a spacecraft in which the sensor 800 is incorporated.

Together, the microchannel plate 806 and the imaging readout 808 can be referred to as an imaging ion detector. In the illustrated embodiment, the imaging ion detector includes a microchannel plate/cross-delay line anode (MCP-XDL). Such an arrangement can allow individual ion events to be amplified and detected with outstanding temporal and spatial resolution (e.g., less than about 15 picoseconds and less than about 50 microns, respectively, in some embodiments). This can allow for high-throughput dispersive energy analysis using very simple ion optics.

A coordinate axis system is shown in FIG. 10 for the sensor 800. The coordinate axes are specifically identified relative to the velocity components ($v_x$, $v_y$, $v_z$) of particles that enter the sensor 800, although the x, y, and z directions apply more generally. A separate arrow indicates the velocity vector of a spacecraft ($v_{sc}$) to which the sensor 800 is coupled, which is directed in the negative x direction. As shown below the microchannel plate 806, a change in $v_x$ corresponds with a change in the z direction at the microchannel plate 806. For example, if incoming particles have a greater $v_x$ component, they will spend less time in the deflector 804 and will be deflected to a lesser extent, and thus will have a smaller displacement in the z direction at the microchannel plate 806. Also shown below the microchannel plate 806 is a direct correlation between a change in the $v_y$ component of particles that enter the sensor 800 and their displacement in the y direction at the microchannel plate 806.

Figure 11:
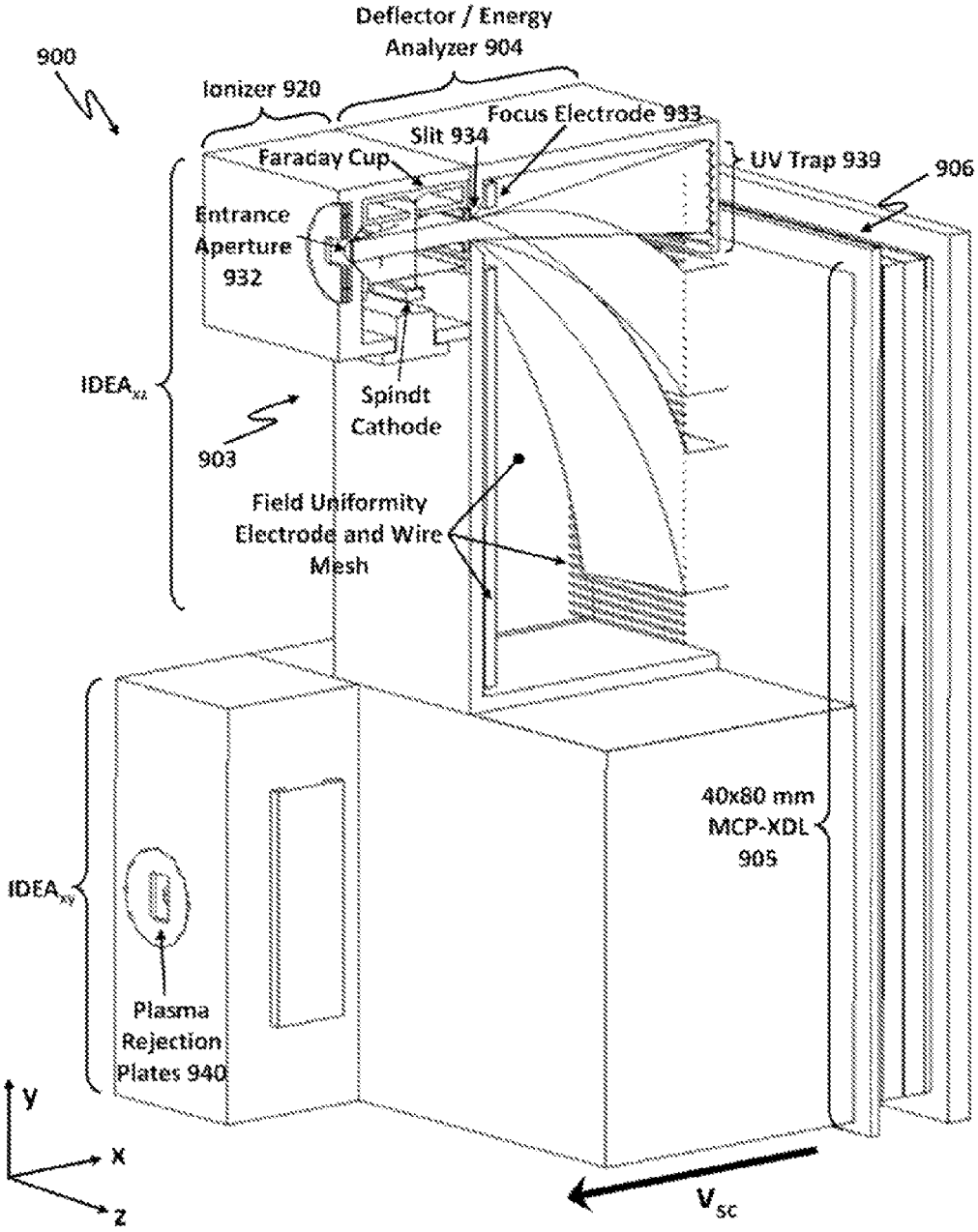
FIG. 11 is a perspective view of another embodiment of a sensor that includes two energy dispersion units oriented orthogonally to one another that share a common detector system, with one of the energy dispersion units shown in cross-section.

FIG. 11 illustrates another embodiment of a sensor 900, which includes two energy dispersion systems 903 oriented orthogonally to each other and which share a common detector system 905. Each energy dispersion system 903 includes an ionizer 920 and an electrostatic deflector 904. A first energy dispersion system 903, along with the portion of the detector system 905 that corresponds thereto, is identified as $IDEA_{xz}$, as this portion of the sensor 900 is configured to sample a substantially planar portion of the atmosphere that extends along an xz plane identified in FIG. 11. Similarly, a second energy dispersion system 903, along with the portion of the detector system 905 that corresponds thereto, is identified as $IDEA_{xy}$, as this portion of the sensor 900 is configured to sample a substantially planar portion of the atmosphere that extends along an xy plane. The remainder of the disclosure herein uses the coordinate system shown in FIG. 11.

Each energy dispersion system 903 includes a deflector system 940, an ionizer 920, and a deflector 904. Each deflector system 940 comprises two plasma rejection plates, which can be biased at about ±30 volts, respectively. An incoming particle stream passes through openings in the plasma rejection plates, which eliminates ions and electrons therefrom. The resulting pure neutral stream is then sampled through a pinhole aperture 932 and is then passed into the ionizer 920. A fraction of neutrals are ionized by electron impact and then delivered to the electrostatic deflector 904. Momentum transfer during electron impact with a neutral atom or molecule is negligible; therefore, nascent positive ions retain the trajectories of their precursor neutral counterparts.

Figure 12:
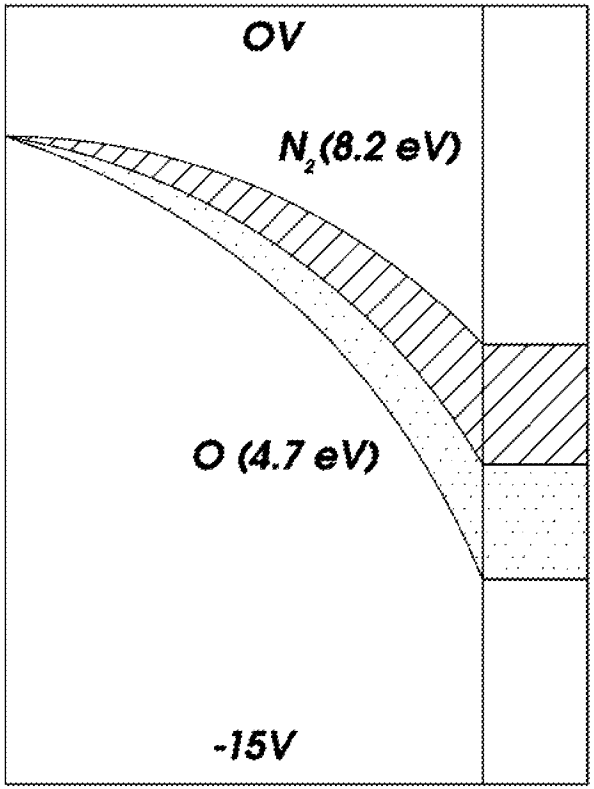
FIG. 12 is a cross-sectional view of one of the energy dispersion units of FIG. 11 illustrating a traced separation of molecular nitrogen and atomic oxygen.

The ions are injected into the electrostatic deflector 904 through a narrow slit 934, and are deflected according to their kinetic energy. As shown in FIG. 11, in some embodiments, a focus electrode 933 can be positioned at the entrance slit 934 to focus and collimate a particle stream that otherwise might be slightly divergent, which can improve the accuracy of wind and temperature measurements of the particle stream. For example, in some embodiments, a small voltage (e.g., no more than about 5, 10, 15, or 20% of the deflection potential of the deflector 904) is applied to the focus electrode 933 so as to focus the particle stream in a direction that is mutually perpendicular to both the x axis and the direction of elongation of the slit 934 (i.e., the z direction for IDEA or the y direction for $IDEA_{XZ}$). In some embodiments, the focus electrode 933 includes two parallel, narrow electrodes that are positioned at the ionizer side of the deflector slit. Ions enter the analyzer with a nominal velocity established by the spacecraft motion itself, and therefore assume a kinetic energy of $\frac{1}{2}mv_{sc}^2$, where m is the ion mass and $v_{sc}$, in some applications, is on the order of about 7500 meters per second. Dispersive energy analysis allows for separation and identification of the dominant thermospheric species O and $N_2$, whose nominal peak energies are 4.7 eV and 8.2 eV, respectively (see FIG. 12).

In various embodiments, the sensor 900 uses a small DC potential (e.g., less than about 15 volts) to generate a static deflection field for energy dispersion. An exit plane of each electrostatic deflector 904 is open, such that all, or substantially all, deflected ions that arrive at the exit plane are delivered to the detector system 905 for imaging. Accordingly, the sensor 900 can operate at a 100% measurement duty cycle.

The illustrated deflector 904 includes a field uniformity electrode to generate a potential gradient along the front wall and sidewalls that extend between the end electrodes (e.g., between an upper plate and a lower plate). For example, as discussed with respect to FIGS. 9A-9C, each of the front wall and sidewalls of the deflector cavity can comprise one or more of a segmented array of electrodes connected through a resistor-based voltage divider, an array of electrodes positioned on a printed circuit board, or a sheet of resistive glass. Such an arrangement can prevent potentials on side walls or neighboring elements from introducing field perturbations into the deflector 904 that would skew ions from their ideal trajectories and significantly increase data analysis difficulty. At the open exit plane of the deflector 904, horizontal wires are arranged in a semi-transparent mesh geometry and separate the deflector 904 from the detector system 905. In some embodiments, either end of each wire contacts an opposing sidewall at the same vertical position so as to generate a potential gradient that matches that of the sidewalls and the front wall.

In some embodiments, the voltage at the entrance slit 934 is applied as a control voltage to the ionizer 920, such as to one or more of the upper, lower, side, front, and rear walls of the ionizer 920 and an ionizer control mesh. This can provide a field-free drift region through the ionizer 920 and into the deflector 904, such that ions do not experience unrepresentative acceleration in the z direction immediately upon entering the deflector 904. In some embodiments, this ionizer control voltage is within a range of from about 90% to about 95% of the voltage of the upper plate of the deflector 904.

Ions that exit the deflector 904 through the wire mesh are accelerated to the front plate of the detector system 905, and their individual arrival times and positions are recorded. The illustrated detector system 905 comprises a MCP-XDL that measures 40 millimeters by 80 millimeters. As previously noted, an active area of the detector system 905 is shared by each IDEA. Various methods are available for spatial readout of individual MCP pulses. For example, cross-delay line anodes can provide excellent spatial resolution with a high maximum count rate. An MCP-XDL system can advantageously combine pulse-counting capabilities with high-resolution imaging.

In certain embodiments, the sensor 900 can include, or can communicate with, a vacuum system (not shown). For example, in some applications, it may be desirable to evacuate the sensor 900 to less than $10^{-6}$ Torr during spacecraft integration and launch so as to prevent exposure of the Spindt cathode and MCP-XDL to elevated pressures. The entire mechanical structure can be hermetically sealed by providing aperture covers to the entrance openings of each IDEA unit. The aperture covers may include o-rings to assist in the sealing procedure.

Moreover, it may be desirable to provide small amounts of vacuum pumping after the sensor 900 has been in use so as to prevent pressure buildup within the electrostatic deflector 904 (i.e., due to ram density enhancement). Such pumping may more likely be desirable when the sensor 900 is used at very low altitudes, such as at about 200 kilometers, where atmospheric pressures approach $10^{-6}$ Torr during periods of high solar activity. The pumping speed may be low, and can be achieved using a non-evaporable getter such as barium, which can provide high pumping speed for a small but continuous atomic oxygen gas load. The getter can be located in a shared volume that vents the ionizer region of each IDEA. Such placement of the getter can advantageously reduce atomic oxygen pressures near the Spindt cathodes while also reducing overall pressure buildup in the deflector 904.

The sensor 900 can also be configured to attenuate UV radiation. Lyman-α radiation by atomic hydrogen in the thermosphere and geocorona produces large fluxes of UV photons that are energetic enough to stimulate certain embodiments of the microchannel plate 906. This can be a significant issue for space-borne microchannel plates 906, even without direct illumination by the sun. Background signals from stray UV radiation can be reduced where the entire active area of the microchannel plate 906 is not within a direct line-of-sight to the atmosphere. In such an arrangement, a minimum of one reflection off a surface that is viewable from the active area of the microchannel plate 906 would be required for any photon to reach the active area. The number and size of such reflective, viewable surfaces can be minimized. For example, dark coatings and roughened surfaces can be used for efficient UV absorption and diffuse scattering. In some embodiments, a UV trap 939 is placed near the plane of the detector system 905 in the direct line-of-sight path that extends through the aperture and slit. In some embodiments, the UV trap 939 includes high-aspect ratio microstructures.

The size, weight, and power (SWaP) envelope of an illustrative embodiment of the sensor 900 and its electronics is summarized in Table 1. As can be appreciated from the listed data, sensors 900 can demonstrate significant reductions in size, weight, and/or power, as compared with known sensor technologies.

TABLE 1

| | |
|---|---|
| Sensor size | 12.5 × 10 × 7.6 cm |
| Electronics size | 12.5 × 9 × 14.5 cm |
| Volume envelope | 2580 $cm^3$ |
| Total mass | 2.7 kg |
| Total power | 11 W |

The base telemetry requirements of the sensor 900 can be low. For example, in some embodiments, the telemetry requirements are no greater than about 40 bytes/second. The sampling rate for fully processed science data can be 20 Hz, using 16-bit words for each of the following: three components of the neutral wind, temperature, five density values (H, He, O, $N_2$, and total), and total counts. The remaining approximately 20 bytes/second can be allocated to housekeeping data, such as, for example, about eight temperature readings. In some embodiments, data processing may be performed onboard so as to reduce the telemetry requirements of a sensor.

In some embodiments, the sensor 900 may occasionally transmit full one-second integrated image frames to ground (e.g., via a telemetry diagnostic mode). Such images can be used to verify proper operation of on-board processing software, such as, for example, through derivation of thermospheric parameters from level 1 data using GSE curve-fitting algorithms. Analysis of complete spatial distributions also allows identification of non-Maxwellian behavior, particularly at high altitudes where collisions become very infrequent and the basic concept of temperature begins to break down. In illustrative cases where each high-resolution image occupies 2 MB of memory, transmission of an image frame every 60 minutes (in addition to processed data) can have an average telemetry rate of 1 kilobyte/second.

Figure 13:
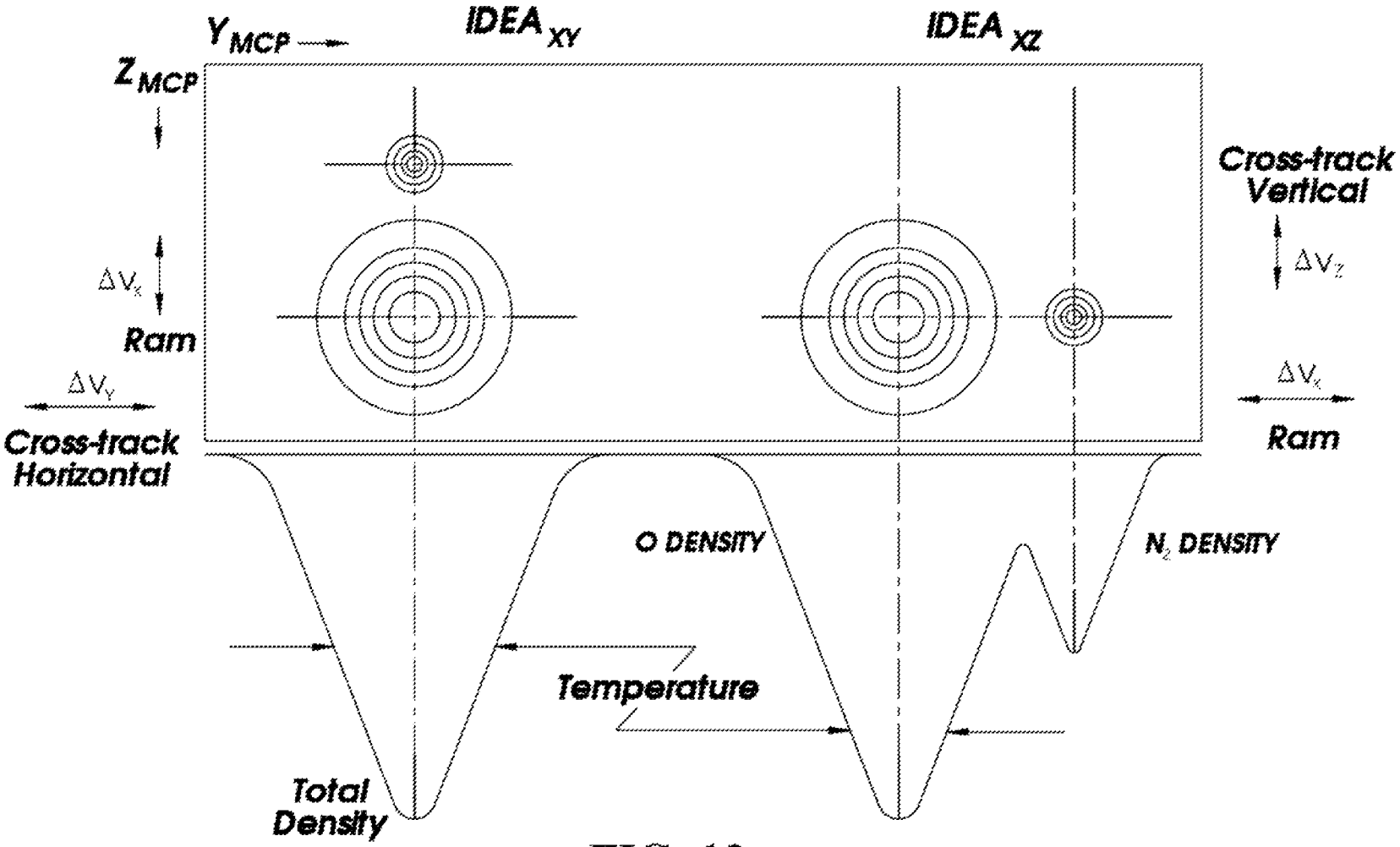
FIG. 13 depicts a combined set of plots that may be obtained via the sensor of FIG. 11, which includes a spatial representation of measurement events and uses different colors or shades to indicate the number of such events at each position, and which illustrates the number of measurement events as a function of position along a y axis of the detector system.

FIG. 13 depicts a combined set of plots that may be obtained via the system of FIG. 11 when used at an atmospheric temperature of 1000 K. The top plot is a spatial representation of measurement events and uses different colors or shades to indicate the number of such events at each position. The bottom plots illustrate the number of measurement events as a function of position along a y axis of the detector system. The plots are similar to those shown in FIGS. 3A-3C.

Discussed hereafter are illustrative measurement methods and data analysis methods that can be employed via the sensors described above. The discussion will focus on the sensor 900, and in particular, the coordinate axes set forth with respect to the same. However, it is to be understood that the methods described can be used with other sensor embodiments described herein. Moreover, while inventive aspects lie in the illustrative methods described, it is to be understood that the specifics of these methods are not necessarily limiting, and other operations, measurements, and analyses may be achieved via the sensors.

Embodiments may include various steps, stages, or control events, which may be embodied in machine-executable instructions to be executed by a general-purpose or special-purpose computer (or other electronic device). Alternatively, the steps, stages, or control events may be performed by hardware components that include specific logic for performing the steps or by a combination of hardware, software, and/or firmware. Some or all of the steps may be performed onboard a spacecraft (e.g., by a sensor itself), or some steps may be performed by different systems (e.g. Earth-based systems) that receive information from a sensor.

Embodiments may also be provided as a computer program product that includes a machine-readable medium having stored thereon instructions that may be used to program a computer (or other electronic device) to perform the processes described herein. The machine-readable medium may include, but is not limited to, hard drives, floppy diskettes, optical disks, CD-ROMs, DVD-ROMs, ROMs, RAMs, EPROMs, EEPROMs, magnetic or optical cards, solid-state memory devices, or other types of media/computer-readable medium suitable for storing electronic instructions.

The total 3D speed distribution of neutrals in the upper atmosphere can be expressed as three 1D velocity distributions. Assuming Maxwellian behavior, these distributions in the spacecraft frame are as follows:

$$f(v_x) = \sqrt{\frac{m}{2\pi kT}}\, e^{\frac{-m(v_x - v_{sc} - w_x)^2}{2kT}} \quad \text{(Eq. 1)}$$

$$f(v_y) = \sqrt{\frac{m}{2\pi kT}}\, e^{\frac{-m(v_y - w_y)^2}{2kT}} \quad \text{(Eq. 2)}$$

$$f(v_z) = \sqrt{\frac{m}{2\pi kT}}\, e^{\frac{-m(v_z - w_z)^2}{2kT}} \quad \text{(Eq. 3)}$$

where m is particle mass, k is the Boltzmann constant, T is the thermospheric temperature, $v_{sc}$ is the spacecraft velocity (e.g., about 7500 meters/second), and $w_{x,y,z}$ are the three components of the neutral wind. Each of these is a shifted normal distribution (drifting Maxwellian), with variance $\sigma^2$ equal to kT/m, and whose individual mean/maximum values are shifted by the neutral wind (in x, y, z) and spacecraft velocity (in x only). Because the spacecraft velocity is significantly greater than typical thermal velocities, atmospheric neutrals sampled through a ram-facing aperture produce a moderately diverging beam. For example, the 3σ thermal velocity of 1000 K atomic oxygen is 2160 meters/second, compared to a spacecraft velocity of roughly 7500 meters/second. This results in a diverging beam with half-angle of $\tan^{-1}(2160/7500)=16°$, which represents an angular boundary containing 99.7% of incoming oxygen atoms. The diverging beam maintains a Gaussian cross-sectional profile as it propagates through the sampling region.

All ions reaching the open exit plane of the deflector are accelerated to the front plate of the MCP-XDL, which allows single-event pulse counting with high spatial resolution. The MCP-XDL records the y and z positions of the ion (see FIG. 13), along with its arrival time. Arrival positions relate to ion mass, velocity distribution, and deflector parameters as follows:

$$\underline{IDEA}_{xy}:\ z = \frac{VqL_1^2}{2Dmv_x^2},\ y = \frac{v_y}{v_x}L_2 \quad \text{(Eq. 4)}$$

$$\underline{IDEA}_{xz}:\ y = \frac{VqL_1^2}{2Dmv_x^2},\ z = \frac{v_z}{v_x}L_2 \quad \text{(Eq. 5)}$$

where V is the deflection voltage, q is the elementary charge ($1.602\times10^{-19}$ C), $L_1$ is the deflector plate length (in the x direction), $L_2$ is the total drift length from the aperture to the detector plane, and D is the deflector plate gap (e.g., the distance between the upper and lower plates).

Velocity distributions in x, y, and z can be recovered from the sensor data. As shown in Equations 4 and 5, ion velocity maps into detector arrival position. Rearrangement of these expressions produces the following relations:

$$\underline{IDEA}_{xy}:\ v_x = \sqrt{\frac{VqL_1^2}{2Dmz}},\ v_y = \frac{v_x y}{L_2} \quad \text{(Eq. 6)}$$

$$\underline{IDEA}_{xz}:\ v_x = \sqrt{\frac{VqL_1^2}{2Dmy}},\ v_z = \frac{v_x z}{L_2} \quad \text{(Eq. 7)}$$

It is noted that $v_x$ is measured redundantly by both IDEA sensors, and that deflection distance is insensitive to the other velocity components. Therefore, $v_x$ can be determined first, and can be used subsequently to calculate $v_y$ and $v_z$, as shown above in Equations 6 and 7.

Following calculation of velocities from detector image data, the velocities are fit to a normal (Gaussian) distribution in each dimension, using a maximal likelihood technique. This fitting routine returns the distribution's standard deviation σ, from which temperature is calculated as follows:

$$T = \frac{\sigma^2 m}{k} \quad \text{(Eq. 8)}$$

Temperature is determined redundantly through four separate distribution fits—twice by each IDEA. Also returned by the fitting routine is a set of mean values $\mu_x$, $\mu_y$, and $\mu_z$, which indicate the position of each distribution's maximum value. Cross-track horizontal and vertical winds are given directly by $\mu_y$ and $\mu_z$, respectively, while subtraction of $v_{sc}$ from $\mu_x$ yields the ram wind.

Accurate wind and temperature measurements can be achieved by determining an IDEA slit transmission function, which modifies and convolves the ram-direction velocity distribution. The IDEA slit transmission function $S(v_x)$ is shown in the following equation:

$$f(v_{x,out})=S(v_x)f(v_{x,in}) \quad \text{(Eq. 9)}$$

Cross-track velocities in the entrance slit plane ($v_y$ for $IDEA_{XY}$ and $v_z$ $IDEA_{XZ}$) are transferred without perturbation through the sensor, allowing straightforward curve fitting. However, the $v_x$ distribution in each sensor is slightly skewed due to sampling bias introduced between the aperture and slit. The angular divergence of the neutral beam exiting the aperture decreases with increasing $v_x$, leading to slightly higher transmission through the slit. This shifts the observed $v_x$ distribution maximum to a higher velocity, resulting in measured ram winds that are systematically in excess of the real values. However, this shift can be corrected by determining the instrument function that, when convoluted with the measured (skewed) distribution, produces the incoming normal distribution of velocities which can then be used to determine the ram wind.

The slit transmission function $S(v_x)$ is determined by integrating over the cross-track velocity distribution normal to the slit ($v_z$ for $IDEA_{xy}$), with integration limits defined as the highest and lowest $v_z$ values that allow ion transmission through the aperture and slit at a given $v_x$. Integration of a normal probability distribution produces the error function:

$$\int f(v_z)dv_z = \frac{1}{2}\mathrm{erf}\left(\frac{v_z}{2}\sqrt{\frac{2m}{kT}}\right) \quad \text{(Eq. 10)}$$

The iteration limits are defined as $$v_z = \pm v_x \frac{s}{2l} \quad \text{(Eq. 11)}$$

where s is the width of the entrance slit and I is the distance between the aperture and slit. The slit transmission function then becomes $$S(v_x) = \int_{v_{z,lower}}^{v_{z,upper}} f(v_z)dv_z = \frac{1}{2}\mathrm{erf}\left(\frac{v_x s}{4l}\sqrt{\frac{2m}{kT}}\right) - \frac{1}{2}\mathrm{erf}\left(\frac{-v_x s}{4l}\sqrt{\frac{2m}{kT}}\right) \quad \text{(Eq. 12)}$$

In practical application, the inverse of this slit function produces scaling factors for a given set of measured $v_x$ values, which are used to perform a weighted maximal likelihood curve fit to a normal distribution. This technique can be very effective in accounting for the slit/aperture sampling bias.

Analysis of the sensitivity of a sensor can be used to accurately retrieve density information from the detector count rate data. Sensitivity depends on ionizer efficiency, sampling aperture and slit geometry, ion transmission through the sensor, and MCP quantum efficiency. The standard efficiency equation for electron impact ionization is:

$$I_{ion} = I_e \sigma N_{ionizer} l \quad \text{(Eq. 13)}$$

where $I_{ion}$ is the total current of ions exiting the ionizer, $I_e$ is the electron emission current, σ is the species- and energy-dependent ionization cross section (about $1.4\times10^{-20}$ $m^2$ for atomic oxygen), $N_{ionizer}$ is the number density of neutrals in the ionization volume, and/is the electron path length through this volume.

For the special case of a diverging neutral stream intersecting a planar sheet of electrons (e.g., as can be achieved with an ionizer arrangement such as that shown in FIG. 11), Equation 13 can be expressed as a function of the ambient (thermospheric) number density $N_{ambient}$ as follows:

$$I_{ion} = I_e \sigma N_{ambient} \frac{\pi r^2}{w} \quad \text{(Eq. 14)}$$

where r is the aperture diameter, and w is the width of the electron sheet containing emission current $I_e$. This assumes a square electron sheet (w=I). This current can be expressed as ion count rate R, and scaled by the relevant instrument parameters as shown below:

$$R = \frac{I_e}{q}\sigma N_{ambient}\frac{\pi r^2}{w} FQ \int S(v_x)dv_x \quad \text{(Eq. 15)}$$

where F is the transmission fraction for ions through the semi-transparent mesh of wires at the output end of the electrostatic deflector, Q is the detector quantum efficiency, and $\int S(v_x)dv_x$ is the geometrical acceptance of neutrals entering the aperture whose trajectories allow transmission through the IDEA entrance slit. Note that this last factor depends on neutral temperature, mass, and aperture-slit geometry.

Knowledge of the slit transmission function $S(v_x)$ allows straightforward determination of atmospheric number density by rearrangement of Equation 15. The classical definition of sensitivity for analytical instrumentation is the change in output signal with changing analyte concentration. For a pulse-counting system, this can be expressed usefully as $R/N_{ambient}$ in cts $s^{-1}$ $cm^3$.

Figure 14:
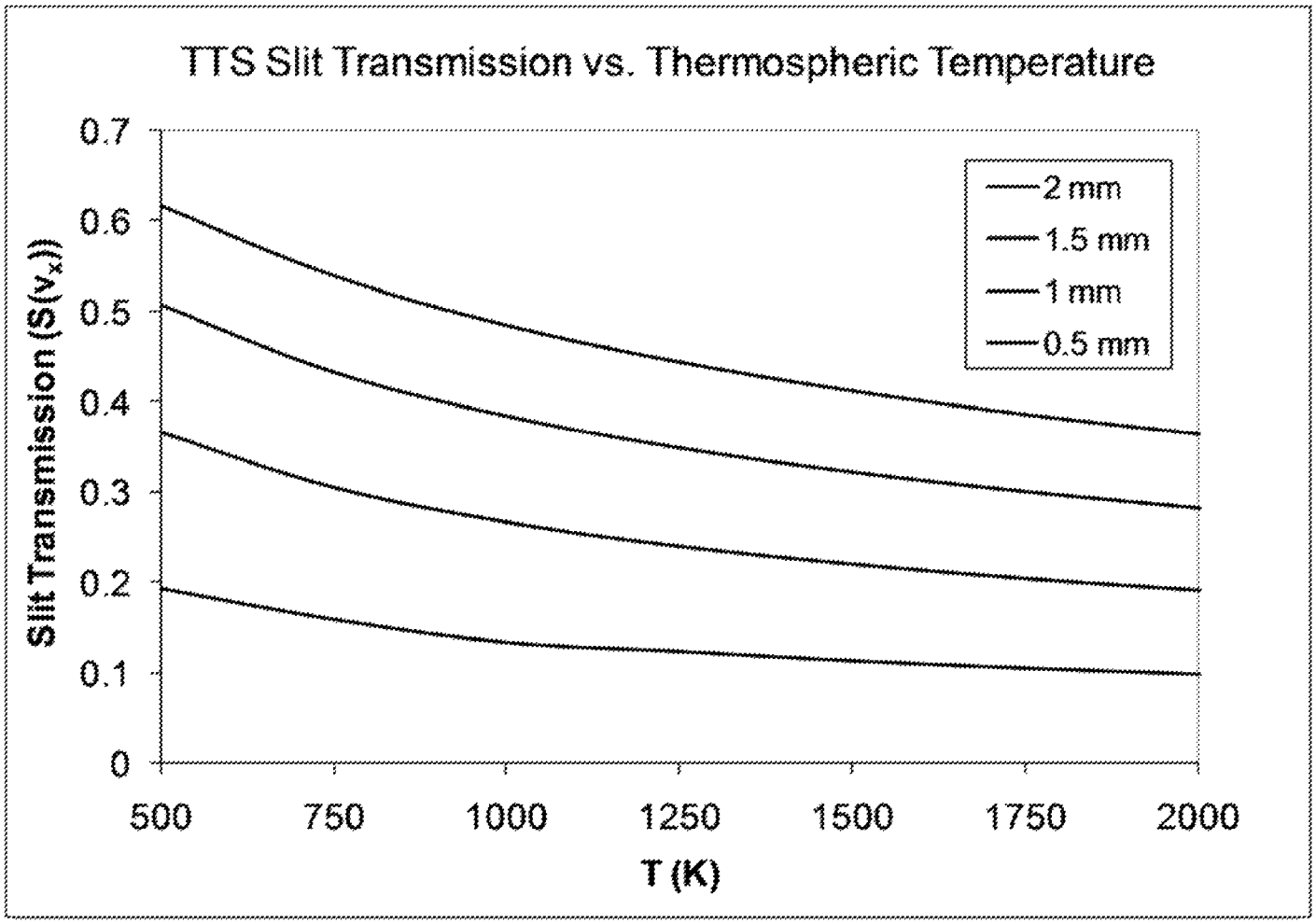
FIG. 14 is a plot of slit transmission for a satellite-borne sensor as a function of atmospheric temperature and of the size of both an input aperture and sampling slit of the sensor.

FIG. 14 is a plot of slit transmission as a function of temperature and aperture/slit size. In the illustrated simulation, an aperture-to-slit distance is 1.5 centimeters, the spacecraft velocity is 7500 meters/second, and the neutrals received into the sensor comply with a mass spectrometer incoherent scatter (MSIS) model of the atmosphere at a distance above the Earth of 400 kilometers with nominally mean solar activity. In order from top to bottom, the curves illustrate a minimum transverse dimension (i.e., diameter for the aperture, thickness for the slit) of 2 millimeters, 1.5 millimeters, 1 millimeter, and 0.5 millimeters.

Additional illustrative embodiments and features thereof are described hereafter. While the following discussion includes inventive embodiments and features, it is noted that the discussion is not intended to be limiting. Additionally, while numbering may not be used frequently hereafter, features may bear the same or similar names to those discussed above.

In some embodiments, an electron emission source will generate ions by electron impact with incoming neutrals. The source of electrons is a Spindt-type cold cathode emitter. Certain Spindt arrays can be configured to operate well in low earth orbit (LEO) conditions. For example, some cathode arrays employ design features tailored to ensure reliable operation for a minimum of five years. In some embodiments, it is desirable to reduce the occurrence of surface discharge breakdowns. It may be desirable to ensure that backup cathodes are available in case of failure, and it may also be desirable for the backup cathodes to permit the electron source to continue uninterrupted when different cathode sets are activated.

In some embodiments, a planar or curved sheet of electrons is desirable for preserving velocity distributions during ionization of the neutral stream. It is also may be desirable for a central section of this sheet, encompassing the neutral-electron interaction volume (e.g., about 5 mm long in some instances), to exhibit uniform current density. In some embodiments, increased sensitivity can be achieved by maintaining the energy of the electrons that are discharged from the cathode at an energy at which the ionization cross-section for atomic oxygen reaches its peak value.

In certain embodiments, electronics that drive the Spindt cathodes can desirably modulate the gain of a sensor as whole, extend the sensor dynamic range, and/or maintain detector count rates in the desired range. The electronics also can be used to prevent signal coincidence loss during periods of high neutral density. In certain embodiments, a cathode drive module can utilize a current control architecture such as that described in U.S. Pat. No. 7,053,558.

In some embodiments, each entrance aperture (e.g., the apertures 932 of the $IDEA_{xz}$ and the $IDEA_{xy}$) will be sealed with a torsional spring-loaded vacuum cover. These covers will be released on-orbit, by rotating about their hinged axis and swinging out of the aperture FOV. Cover actuation will be initiated by, for example, a miniature TiNi frangibolt or pinpuller actuator. Both the covers and the actuator systems can fit within the sensor envelope volume set forth above in TABLE 1, in some embodiments. In some embodiments, a nichrome wire cutting device for polyethylene tethers may be used. The tethers are staked down appropriately to prevent loose ends from obstructing the instrument's FOV. To improve reliability, a double tether/double cutter method may be used to reduce risk of inadvertent or failed actuation.

One embodiment for the implementation of a sensor on a spacecraft uses an Interface and Control Unit (ICU). The ICU interfaces directly with a spacecraft bus for power, command and control, and data transmission through the spacecraft "Data Port," which in some embodiments may comprise a 62 pin HDD connector on the payload module. The ICU receives a primary input voltage between 22 and 36 VDC, supplied by the spacecraft power bus. This primary power is converted using multiple high efficiency, low noise, isolated DC/DC convertors to generate the local analog and digital voltages. A single-point ground scheme may be used. In some embodiments, the total power required is no more than about 11 W. The interface board also supplies all needed commands, monitors the status, and collects, processes, and formats the data from the sensor. Command and Control and real-time data occur via dedicated EIA-422 UARTs from the Payload Interface Board (PIB). All commands issued to the instrument are passed from the PIB via an RS-422 bus. This link is limited to 240 bytes/sec and is intended for real-time instrument state-of-health monitoring only, and will be used for low-rate housekeeping data such as voltages, currents, and temperatures. High-speed science data intended for on-board spacecraft storage and scheduled telemetry is transmitted over an NRZ-L format link directly to the spacecraft Data Handling Subsystem, via the Payload Interface Board (PIB). This link is capable of 2 Mbit/sec synchronous data transfer.

The Interface Control C&DH system can comprise a Modular Avionics System (MODAS) Bus Interface Controller (BIC) single board computer. The MODAS BIC is designed around the radiation tolerant GR712RC microprocessor and provides a configurable 100 MIPS dual processor with a floating point math processor. MODAS can perform CCSDS encoding and has multiple onboard interfaces available including 1553, SpaceWire, and RS-422. The BIC also features radiation hardened OTP PROM for the storage and execution of critical boot code, assuring software updates can be made in the event of corruption to software due to radiation effects. The use of MODAS can allow for a flexible control architecture and ease of interfacing to other data formats, as well as providing the calculating power needed for advanced processing of science data. All C&DH states, functionality, and communications can be implemented using MODASsoft software suite. MODASsoft operates on the MODAS BIC in the UNIX environment using POSIX libraries and Wind Rivers Systems' VxWorks operating system. MODASsoft uses a multi-threaded architecture to provide design modularity. MODAS and MODASsoft are available from the Space Dynamics Laboratory of North Logan, Utah.

In some embodiments, a design tradeoff exists between measurement accuracy and precision. For example, large apertures can improve sensitivity and count rate, which can improve curve fitting and, therefore, precision (i.e., reproducibility between measurements). However, large apertures also can introduce systematic error due to aperture-induced spatial distribution broadening, thereby potentially degrading measurement accuracy (i.e., error between the measured and real values). With this tradeoff in mind, extensive modeling has been conducted to identify an illustrative embodiment of a design suitable for certain Low Earth Orbit applications. The design includes an aperture diameter of 2 mm, a slit width 2 mm, and an aperture-to-slit separation of 1.5 cm. Other instrument parameters used to generate data shown below are as follows: electron current=1 mA; electron energy=120 eV; electron sheet width=5 mm; deflector plate dimensions=3 cm long×4.5 cm tall×4 cm wide; deflection potential=15 V; microchannel plate spatial resolution=250 microns. This geometry can provide a suitable accuracy-to-precision tradeoff while meeting measurement goals as stated in BAA RV-10-02 Call 001 (see Table 2 below).

TABLE 2

| | BAA RV-10-02 Call 001 Neutral Wind Performance Requirements | | | |
|---|---|---|---|---|
| Wind Component | Dynamic Range (m/s) | Accuracy (m/s) | Precision (m/s) | Sample Rate |
| Ram | 0 to ±500 | The larger of ±5 m/s or ±5% | ±5 | 0.5 Hz |
| Cross Track | 0 to ±500 | The larger of ±5 m/s or ±5% | ±5 | 0.5 Hz |

Modeled dynamic range, accuracy, and precision values for wind, temperature, and number density measurement for the above-described design are shown in Table 3:

TABLE 3

| | | Modeled accuracy and precision | | | | | |
|---|---|---|---|---|---|---|---|
| | | Accuracy (measurement error from absolute) | | | | | |
| | Dynamic | Using raw image | Using corrected data | Precision (reproducibility, ±1 s.d.) as a function of integrated $O^+$ counts | | | |
| | Range | data | (estimate) | 10,000 cts | 25,000 cts | 100,000 cts | 250,000 cts |
| Ram wind: $w_x$ (m/s) | 0 to ±750 m/s | 4.3 | <2 | 8.8 | 5.3 | 2.7 | 1.8 |
| Cross-track winds: $w_{y,z}$ (m/s) | 0 to ±750 m/s | 1.3 | 1.3 | 7.8 | 4.8 | 2.6 | 1.5 |
| T (K) | Up to ~2500K | 19 | <5 | 14.1 | 9.0 | 4.3 | 2.6 |
| N ($m^{-3}$) | $10^{10}$ to $10^{17}$ $m^{-3}$ | <1% | <1% | — | <0.5% | — | — |

Models show that cross-track wind measurement error is extremely small in the illustrative sensor, and is dominated by small uncertainties in the attitude knowledge (±0.03° around each axis; 3σ). Conversely, this attitude knowledge error produces negligible error in the ram direction wind, which is established by sensor instrument effects. Table 3 also indicates that a precision goal of ±5 m/s is met when at least 25,000 counts (O+ only) are collected over a given integration time. The lowest count rates anticipated over mission lifetime occur during low solar activity at 500 km altitude, and are about 18,000 cts/s (See FIG. 16). Therefore, at a sample rate of 0.5 Hz, the illustrative sensor meets the precision measurement goal in all conditions, even in rarified atmospheres at 500 km.

Figure 15:
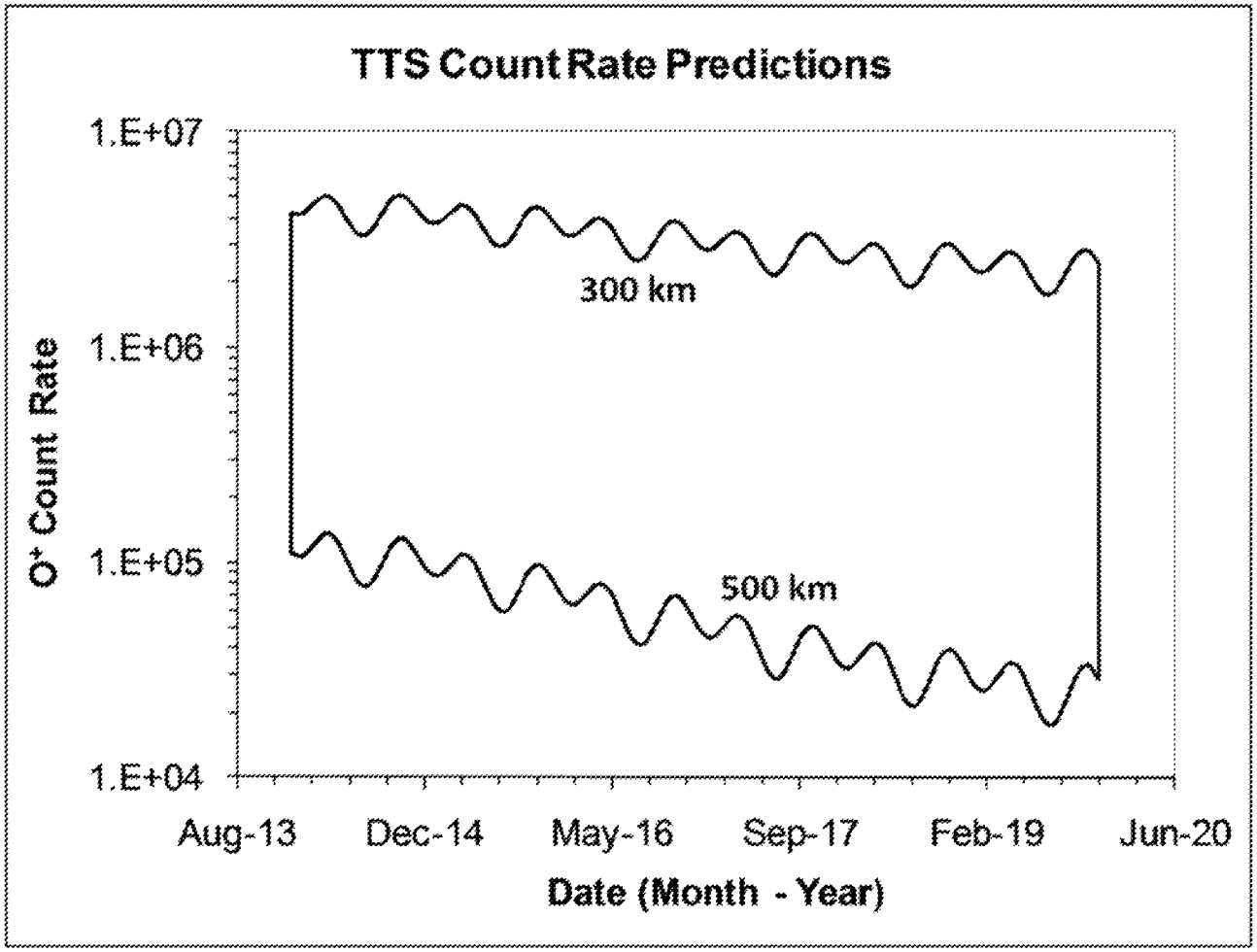
FIG. 15 is a plot of an anticipated ionized atomic oxygen count rate over the course of a lifetime of an embodiment of a sensor.

FIG. 15 is a plot of an anticipated ionized atomic oxygen count rate over the course of a lifetime of an embodiment of a sensor. The plot is based on MSIS-E-90 atomic oxygen densities for circular equatorial orbits between 300 and 500 km, derived from monthly F10.7 predictions. Count rates assume 1 mA emission current, and do not reflect gain control achieved by changing the emission current.

As seen in FIG. 15, the illustrative sensor might often operate in "saturation mode," where high neutral densities may prompt the use of gain control through reduction of ionizer emission current so as to maintain count rates below about 500,000 per second. Under these conditions, the sampling rate of the sensor can be increased to values as high as 20 Hz, dramatically improving spatial resolution while still meeting measurement precision requirements as above. In some embodiments, the sensor may always operate at this sampling rate, and data can be averaged on the ground over a number of consecutive scans to reach the desired measurement precision.

For the design under present consideration, detector spatial distribution broadening impacts the measurement accuracy for temperature more than wind (see Table 3), assuming curve fitting of raw data. Either the spatial or derived velocity distribution can be corrected with a known convolution function that includes aperture geometry and microplate channel resolution effects. This technique can allow temperature measurement error to be reduced greatly, as seen in Table 3. Because the calculated temperature can used to determine $w_x$ (see discussion above), this correction also could improve ram wind accuracy. Additionally, as noted above, $w_x$ can be measured redundantly by both an $IDEA_{xz}$ unit and an $IDEA_{xy}$ unit, as is temperature, resulting in improved precision values through doubled effective ion counts.

Dispersive energy analysis and imaging ion event detection thus can improve sensitivity gains achieved with 100% measurement duty cycle. Additionally, for some embodiments, a surprising result is that a relatively large aperture of 2 mm produces accurate measurements in a compact sensor package. This can allow high count rates and reliable wind and temperature measurements even in cold, rarified atmospheres, at much higher altitudes than known thermosphere sensors allow.

Although the foregoing devices, systems, and methods are described in the context of spacecraft and spacecraft systems, it is noted that other applications of the sensors are also possible. For example, in some applications, the sensor 100 may be fixed relative to the Earth and high velocity particle streams may be applied thereto.

Certain terms in this written disclosure and/or the claims that follow include the qualifiers "substantially" and "generally." It is noted that these terms include within their scope the qualified words in the absence of their qualifiers. For example, the term "substantially parallel" includes within its scope a precisely parallel orientation.

It will be understood by those having skill in the art that changes may be made to the details of the above-described embodiments without departing from the underlying principles presented herein. For example, any suitable combination of various embodiments, or the features thereof, is contemplated.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this Detailed Description are hereby expressly incorporated into this Detailed Description, with each claim standing on its own as a separate embodiment. This disclosure includes all permutations of the independent claims with their dependent claims. Recitation in the claims of the term "first" with respect to a feature or element does not necessarily imply the existence of a second or additional such feature or element. Elements specifically recited in means-plus-function format, if any, are intended to be construed in accordance with 35 U.S.C. §112 ¶ 6. Embodiments of the invention in which an exclusive property or privilege is claimed are defined as follows.

The invention claimed is:

1. A sensor comprising:

an aperture system configured to permit a sample of particles from a bulk collection of particles to enter the sensor when the particles have a mean velocity vector relative to the sensor in a first direction, the aperture system comprising an opening elongated in a second direction that is substantially perpendicular to the first direction;

an electrostatic deflector configured to provide an electric field in a third direction that is substantially perpendicular to each of the first and second directions such that the electric field can deflect the sample of particles in the third direction when the sample of particles carries a charge, wherein the electrostatic deflector comprises a screen at an output end;

a two-dimensional imaging readout positioned to receive deflected particles from the electrostatic deflector; and a microchannel plate positioned between the electrostatic deflector and the imaging readout;

wherein a periphery of the output end of the electrostatic deflector defines a transverse area that extends in both the second and third directions, and wherein no less than about 50 percent of the transverse area is open and in direct communication with the microchannel plate such that particles can be delivered to the microchannel plate through the open portion of the transverse area and wherein openings in the screen define the open portion of the transverse area.

2. The sensor of claim 1, wherein the imaging readout is selected from the group consisting of cross delay line anode (XDL), resistive anode, wedge-and-strip anode, segmented anodes, discrete anodes, Vernier anode, cross-strip anode, application specific integrate circuit (ASIC) arrays, phosphor screen, intensified charge-coupled device (CCD), and charge injection device.

3. The sensor of claim 1, wherein no less than about 75 percent of the transverse area is open and in direct communication with the microchannel plate.

4. The sensor of claim 2, wherein the imaging readout defines an imaging area that either is approximately the same size as or larger than the open portion of the transverse area of the electrostatic deflector.

5. The sensor of claim 1, wherein the electrostatic deflector is in direct communication with the microchannel plate such that particles that exit from the electrostatic deflector do not pass through a separate filter prior to being delivered to the microchannel plate.

6. The sensor of claim 5, wherein particles pass out of the electrostatic deflector through the screen when traveling to the microchannel plate.

7. The sensor of claim 1, wherein the microchannel plate and the imaging readout cooperate to provide a two-dimensional representation of particles that enter the input end of the microchannel plate from the electrostatic deflector.

8. The sensor of claim 1, wherein the electrostatic deflector comprises one or more sidewalls and wherein the one or more sidewalls and the screen assist in providing an electric field having a substantially constant magnitude throughout the electrostatic deflector.

9. The sensor of claim 1, wherein the aperture system comprises an additional opening that is smaller than the elongated opening, and wherein the additional opening is spaced from the elongated opening.

10. The sensor of claim 9, wherein the additional opening is positioned relative to the elongated opening such that particles entering the sensor pass through the additional opening before passing through the elongated opening.

11. The sensor of claim 1, further comprising an ionizer configured to impart a charge to particles before they enter the electrostatic deflector.

12. The sensor of claim 1, further comprising a deflector system that is configured to provide an electric field that prevents charged particles from entering the sensor through the aperture system.

13. A sensor that defines first, second, and third mutually orthogonal axes, the sensor comprising:

an aperture system configured to permit a sample of particles from a bulk collection of particles to enter the sensor when the particles have a mean velocity vector relative to the sensor substantially in a direction in which the first axis extends;

an electrostatic deflector configured to provide an electric field substantially along a direction in which the third axis extends such that the electric field can deflect the sample of particles in the direction of the third axis when the sample of particles carries a charge, wherein the electrostatic deflector comprises a screen at an output end;

a detector system comprising a microchannel plate and a two-dimensional imaging readout at the output of the microchannel plate, the microchannel plate positioned between the electrostatic deflector and the imaging readout;

wherein the microchannel plate defines an input end and an output end, wherein the input end is positioned to receive deflected particles from the electrostatic deflector; and wherein a periphery of an output end of the electrostatic deflector defines a transverse area, and wherein no less than about 50 percent of the transverse area is open and in direct communication with the microchannel plate such that particles can be delivered to the microchannel plate through the open portion of the transverse area and wherein openings in the screen define the open portion of the transverse area.

14. The sensor of claim 13, wherein the electrostatic deflector is in direct communication with the microchannel plate such that particles that exit from the electrostatic deflector do not pass through a separate filtering aperture prior to being delivered to the microchannel plate.

15. The sensor of claim 13, wherein the microchannel plate and the imaging readout cooperate to provide a two-dimensional representation of particles that enter the input end of the microchannel plate from the electrostatic deflector when the electrostatic deflector provides a substantially constant electric field.

16. A sensor system comprising:

a first sensor comprising;

an aperture system configured to permit a sample of particles from a bulk collection of particles to enter the sensor when the particles have a mean velocity vector relative to the sensor in a first direction, the aperture system comprising an opening elongated in a second direction that is substantially perpendicular to the first direction;

an electrostatic deflector configured to provide an electric field in a third direction that is substantially perpendicular to each of the first and second directions such that the electric field can deflect the sample of particles in the third direction when the sample of particles carries a charge, wherein the electrostatic deflector comprises a screen at an output end;

a microchannel plate defining an input end and an output end, wherein the input end is positioned to receive deflected particles from the electrostatic deflector, wherein particles pass out of the electrostatic deflector through the screen when traveling to the microchannel plate and wherein the electrostatic deflector is in direct communication with the microchannel plate such that particles that exit from the electrostatic deflector do not pass through a separate filter prior to being delivered to the microchannel plate; and an imaging readout at an output end of the microchannel plate, the imaging readout comprising a plurality of anodes that extend in the second direction and a plurality of anodes that extend in the third direction; and a second sensor comprising:

an aperture system configured to permit a sample of particles from a bulk collection of particles to enter the sensor when the sensor moves through the bulk collection of particles in the first direction, the aperture system comprising an opening elongated in the third direction.

17. The sensor system of claim 16, wherein the second sensor further comprises:

an electrostatic deflector configured to provide an electric field in the second direction;

a microchannel plate defining an input end and an output end, wherein the input end is positioned to receive deflected particles from the electrostatic deflector; and a two-dimensional imaging readout at an output end of the microchannel plate, the imaging readout comprising a plurality of anodes that extend in the second direction and a plurality of anodes that extend in the third direction.

18. A method of detecting properties of atmospheric particles, the method comprising:

receiving atmospheric particles through an elongated opening, wherein the atmospheric particles comprise a first species and a second species, and wherein the first species has a smaller energy than does the second species;

deflecting the particles via an applied electric field in an electrostatic deflector such that the first species is deflected to a greater extent than is the second species, wherein the electrostatic deflector comprises a screen at an output end;

delivering both the first and second species of deflected particles through the screen to a microchannel plate, wherein delivering comprises delivering the first and second species of deflected particles directly to the microchannel plate such that the first and second species of deflected particles that exit from the electrostatic deflector do not pass through a separate filter prior to being delivered to the microchannel plate; and delivering output signals representing both the first and second species from the microchannel plate to a two-dimensional anode array, wherein the microchannel plate is positioned between the electrostatic deflector and the anode array.

19. The method of claim 18, wherein the anode array comprises multiple rows and columns of anodes.

20. The method of claim 18, further comprising imparting a charge to the particles prior to deflecting the particles via the electric field.

21. The method of claim 18, wherein delivering both the first and second species of deflected particles to a microchannel plate is accomplished without altering the magnitude of the applied electric field.

22. The method of claim 18, further comprising delivering no fewer than about 50 percent of the deflected particles to the microchannel plate.

23. The method of claim 22, further comprising delivering substantially all deflected particles to the microchannel plate.

24. A method of detecting properties of atmospheric particles, the method comprising:

receiving atmospheric particles through an elongated opening, wherein the particles comprise a first species and a second species, and wherein the first species has a smaller mass than does the second species;

passing the particles through an electrostatic deflector that provides an electric field and wherein the electrostatic deflector comprises a screen at an output end;

deflecting the particles via the electric field such that the first species is deflected to a greater extent than is the second species;

delivering the particles through the screen to a microchannel plate positioned between the electrostatic deflector and a two-dimensional imaging readout, wherein a periphery of the output end of the electrostatic deflector defines a transverse area, and wherein no less than about 50 percent of the transverse area is open and in direct communication with the microchannel plate, wherein delivering comprises delivering the particles to the microchannel plate through the open portion of the transverse area, wherein openings in the screen define the open portion of the transverse area; and detecting, using the two dimensional imaging readout, a two-dimensional spatial orientation of the deflected particles at an output end of the microchannel plate.

25. The method of claim 24, further comprising maintaining a substantially constant electric field within the electrostatic deflector such that the two-dimensional spatial orientation of the deflected particles is detected without changing the strength of the applied electric field.

* * * * *